US006000780A

United States Patent [19]

Schwiebert et al.

[11] Patent Number: 6,000,780

[45] **Date of Patent: *Dec. 14, 1999**

[54] WIPING SYSTEM FOR INKJET PRINTER

[75] Inventors: William H. Schwiebert, Cardiff; Gerold G. Firl, Poway, both of Calif.

[73] Assignee: Hewlett-Packard Company, Palo Alto, Calif.

[ * ] Notice: This patent is subject to a terminal disclaimer.

[21] Appl. No.: 08/225,039

[22] Filed: Apr. 8, 1994

[51] Int. Cl.[6] ..... B41J 2/165

[52] U.S. Cl. ..... 347/33; 15/256.5

[58] Field of Search ..... 347/33, 24, 29, 347/32; 15/256.5

[56] References Cited

U.S. PATENT DOCUMENTS

| | | | |
|---|---|---|---|
| 4,580,150 | 4/1986 | Tazaki | 347/37 |
| 4,951,066 | 8/1990 | Terasawa et al. | 347/33 |
| 5,103,244 | 4/1992 | Gast et al. | 347/33 |
| 5,126,765 | 6/1992 | Nakamura | 347/33 |

FOREIGN PATENT DOCUMENTS

| | | | |
|---|---|---|---|
| 0589582 | 3/1994 | European Pat. Off. | 347/33 |
| 589582 A2 | 3/1994 | European Pat. Off. | 347/33 |
| 3-246052 | 11/1991 | Japan | 347/33 |

OTHER PUBLICATIONS

Condensed Chemical Dictionary, Richard J. Lewis, Jr., p. 936, 1993.

*Primary Examiner*—John Barlow
*Assistant Examiner*—Judy Nguyen
*Attorney, Agent, or Firm*—Jerry R. Potts

[57] ABSTRACT

A service station for use with an inkjet printer is described. The service station includes a sled that is mounted to the printer's chassis. Caps and wipers can be mounted on the sled for each of the printer's movable carriage-mounted printheads. The sled and the chassis, and the sled and carriage, are each cam-coupled so that movement of the carriage produces slight vertical and lateral movement of the sled out of a nominal position to automatically place the sled in one of three primary positions relative to the carriage: an elevated position for capping the printheads, an intermediate position for wiping the printheads and a lowered position for free reciprocal movement of the carriage without interference between the printheads and either the caps or the wipers. A wiper structure according to the invention includes a pre-loaded spring and wiper blades made of a relatively stiff material so that the wiper blade angle of attack is maintained close to 90°, resulting in good wiping of the printheads. The spring can have a low spring constant so that good control of wiping forces is maintained. The wiper blades are made of an injection moldable material. For example, the wiper blades can be made of an injection moldable polymer such as olefin polymers or polyolefin alloys. In one particular embodiment, the wiper blades are made of a blend of polypropylene and polyethylene. Alternatively, the wiper blades can be made of an engineering thermoplastic elastomer (ETE).

23 Claims, 16 Drawing Sheets

WIPING SYSTEM FOR INKJET PRINTER

BACKGROUND OF THE INVENTION

1. Field of the Invention

The present invention relates generally to inkjet printers and, in particular, to wiping the printheads of one or more print cartridges of an inkjet printer. Most particularly, the invention relates to method and structure that depend upon printer carriage motion for automatic, uni-directional, separate wiping of each printhead utilizing an integrated removable wiper structure.

2. Related Art

Inkjet printhead nozzles commonly become plugged with ink blobs or particulate, or otherwise contaminated with internal bubbles that prevent the nozzles from operating properly, resulting in lower print quality. Consequently, inkjet printers typically include a service station that provides for spitting, wiping, capping and priming of single printheads in order to keep the printhead nozzles clean and functioning.

Conventional service stations frequently require operator intervention and often take the printer off-line for several seconds. It is desirable to automate printhead servicing to free the operator for other tasks, and to perform servicing as quickly as possible.

Failure recovery methods and systems have been proposed that provide for the automatic recovery from a condition in a plural printhead inkjet printer in which the printhead's nozzles become clogged with ink and particulate, wherein the method includes capping the printheads, selectively priming and flushing a given printhead and then uncapping and wiping the printheads. One such method and system is described in commonly owned, copending U.S. patent application Ser. No. 07/949,318, entitled "Automatic Failure Recovery for Ink-jet Printheads," filed on Sep. 21, 1992, the disclosure of which is incorporated herein by reference.

Wiping in conventional service stations is typically done with a single wiper that wipes the printhead in each of two directions. This is undesirable because wiping an inkjet printhead in two directions results in recontamination of a printhead during wiping, and wiping multiple printheads with a single wiper surface results in inter-printhead contamination.

Previously, wiper blades have been mounted below a surface of a movable sled and extended through a hole in the surface. Consequently, the wiper blades have been relatively long and, therefore, not as stiff as desired. Generally, it is desirable to make the wiper blades as stiff as possible, without damaging the printhead, so that the most effective wiping will be obtained.

Additionally, the angle at which the wiper blade wipes across the printhead ("wiper blade angle of attack") has been found to be an important factor in effective wiping of the printhead. Generally, the most effective wiping is obtained when the wiper blade angle of attack is as close as possible to 90°.

Previously, wiper blades have been made of rubber. A rubber wiper blade bends as the wiper blade comes into contact with the print cartridge. The amount of bending, i.e., the amount by which the wiper blade angle of attack deviates from the desired 90° angle, depends upon the amount of interference between the wiper blade and the print cartridge. In previous service stations, cumulation of tolerances associated with the nominal positions of the service station sled (on which the wiper blades are mounted) and the print cartridge printheads necessitate a large nominal interference between the wiper blades and the printheads in order to ensure contact between the wiper blades and the printheads during wiping. This large interference results in a wiper blade angle of attack that is typically less than 30° when rubber wiper blades are used. Thus, rubber wiper blades do not wipe as well as desired.

Further, with rubber wiper blades, "shingling" of the wiper blades can result after prolonged used of the wiper blades, particularly in low humidity and low temperature environments. Shingling is a microscopic defect on the surface of the wiper blade that, during wiping, can cause air bubbles to be transmitted into the nozzles of the print cartridge. These air bubbles can cause ink to be displaced from the firing chamber of the print cartridge so that the print cartridges will not print, necessitating priming of the print cartridge in order to restore printing capability.

In order to achieve good wiping, it is necessary to maintain a minimum wiping force between the wiper blades and the printheads. It is also desirable that the wiping force remain approximately constant despite variations in the amount of interference between the wiper blades and the printhead. Further, the wiper blades must maintain contact with the printhead along the entire length of the wiper blade to achieve the best wiping. Thus, the wiper blade must be supported by a structure that accomplishes these functions.

Print cartridges containing a pigmented ink, e.g., a black pigmented ink, are particularly difficult to wipe effectively, as compared to print cartridges containing a dye. Thus, the above-noted characteristics of a good wiper blade, e.g., stiffness, wiper blade angle of attack near 90° and adequate wiping force, are particularly important for wiper blades that wipe printheads of print cartridges that dispense pigmented ink.

Because of the frequent contact between the wiper blades and the print cartridge, the wiper blades wear out quicker than the remainder of the service station, e.g., the capping mechanism and the service station sled. Consequently, it is desirable that a user be able to replace the wiper blades or wiping structure without the necessity of replacing the remainder of the service station.

SUMMARY OF THE INVENTION

An apparatus according to the invention includes a sled mounted to a printer chassis, pairs of caps and wipers mounted on the sled, one pair for each of the print cartridges mounted on a print carriage. The sled and the printer chassis are cam-coupled for controlled, relative movement therebetween. The sled and the print carriage are also cam-coupled for controlled, relative movement therebetween. Movement of the print carriage produces slight vertical and lateral movement of the sled to place the sled in one of three primary positions relative to the print carriage: an elevated position for capping and priming the printheads, an intermediate position for wiping the printheads and a lowered printing position for free reciprocal movement of the print carriage without interference between the printheads and either the caps or the wipers. Thus, a controller that includes only the printer's carriage drive motor provides printer servicing, including capping and wiping.

A method according to the invention involves uncapping the printheads, wiping the printheads, lowering the sled to the printing position beneath the printheads, optionally re-wiping the printheads repeatedly, and returning the printheads to the capping position. During wiping, ink may be spit from the print cartridge on to the wiper to enhance wiping. Alternatively, ink may be spit onto the printhead before wiping to aid in wiping. The method and apparatus of the invention are compatible with automatic priming of selected ones of the printheads.

Wiping is uni-directional, thereby avoiding recontamination of a printhead that may occur during a return wipe if bi-directional wiping is used. Further, each printhead is wiped by only one wiper, thereby avoiding contamination of the printhead with ink or contaminants from another printhead. Importantly, there is no permanent lock-out state of the method and apparatus from which printing cannot resume without operator intervention.

In one embodiment of a wiping structure according to the invention, a wiper including a wiper blade is attached to a spring means. The wiper blade is positioned with respect to a corresponding print cartridge such that, viewed in a direction perpendicular to a direction of movement of the print cartridge during wiping, the wiper blade overlaps the print cartridge when the wiper is not wiping. The wiper blade is made of a stiff material that remains substantially unbent when wiping, the spring means deflecting during wiping so that the wiper blade contacts the printhead.

Since the wiper blade is stiff, good wiping is achieved. Further, the spring means, in combination with the shape and material of the wiper blade, preferably maintain the wiper blade angle of attack at approximately 75° or greater during wiping, further improving wiping.

The spring means is preloaded to maintain a minimum wiping force of the wiper blade against the printhead of the corresponding print cartridge. Since the spring means is preloaded, the spring means can have a low spring constant while maintaining a minimum wiping force. The low spring constant minimizes variations in wiping force that result from variations in deflection of the wiper blades that can result from, for instance, tolerances associated with assembly of the wiper structure with respect to the printheads. In one embodiment, the spring means has a spring constant such that, for the range of possible deflections of the wiper blade, a maximum wiping force is less than or equal to 40% greater than the minimum wiping force.

The spring means can be, for instance, one or more leaf springs. In one particular embodiment, the spring means comprises first and second leaf springs. A cross member connects the first and second leaf springs. The wiper blade is mounted on the cross member. The cross member is formed such that, during wiping, the cross member deforms so as to maintain the wiper blade in contact with the printhead along an entire length of the wiper blade.

Material can be selectively removed from and added to the cross member to achieve desired stiffness characteristics in different directions. For instance, material can be removed from the portions of the cross member between the wiper blade and leaf springs so that the wiper blade can gimbal, thus allowing the wiper blade to move as necessary to maintain good contact with the printhead. Additionally, material can be added in the region where the wiper blade is mounted in order to impart additional stiffness in a direction parallel to wiping, thus helping to maintain the desired steep wiping angle.

In a further embodiment of the invention, a wiping structure includes a plurality of wipers attached to a spring means, as described above, each wiper and spring means corresponding to one of a plurality of print cartridges.

According to the invention, the wiper blades are made of an injection moldable material. For example, the wiper blades can be made of an injection moldable polymer such as olefin polymers or polyolefin alloys. In one particular embodiment, the wiper blades are made of a blend of polypropylene and polyethylene. Alternatively, the wiper blades can be made of an engineering thermoplastic elastomer (ETE).

Wiper blades made of one of the above materials do not wear as easily as previous wiper blades, e.g., rubber wiper blades. Additionally, injection molding the wipers onto the cross member is a simple and inexpensive method for producing wipers according to the invention.

Though a particular embodiment of the invention is described above, generally, according to the invention, wipers made of an injection moldable material are injection molded onto any carrier that achieves the above-described functions.

The structure according to the invention can also include structure for suppressing noise. The noise suppression means can be a bumper that reduces the force of an impact between the sled and a wall of the chassis. In one embodiment, a structure according to the invention includes a sled body mounted on a chassis. A wiper structure is attached to the sled body. A cap mount is formed on the sled body and a cap structure is mounted on the cap mount. A bumper is formed at one end of the cap structure such that when the sled body moves to a position at which the sled body would otherwise contact the chassis, the bumper contacts a wall of the chassis, thereby reducing noise resulting from the contact.

DETAILED DESCRIPTION OF EMBODIMENTS OF THE INVENTION

Figure 1A:
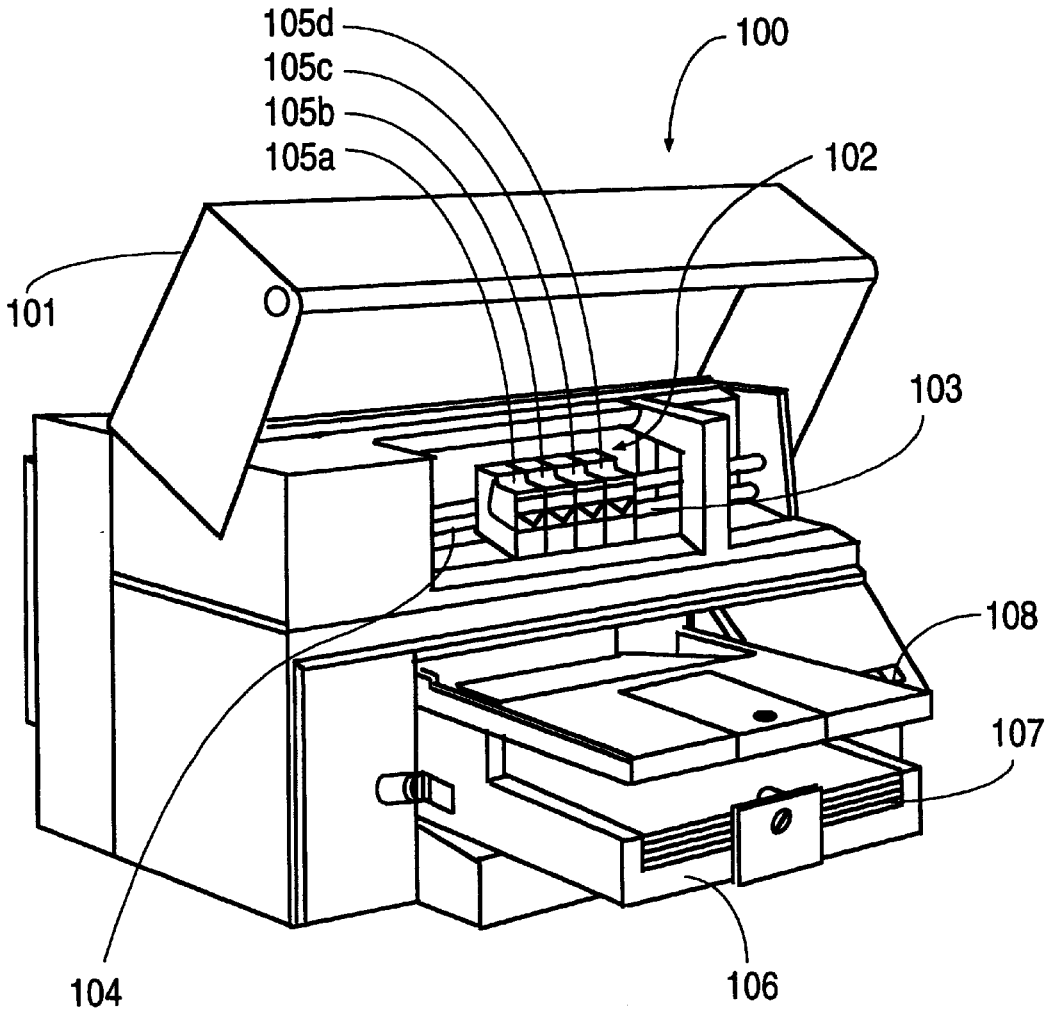
FIG. 1A is a simplified perspective view of an inkjet printer according to the invention illustrating a printing mode of operation.

FIG. 1A is a simplified perspective view of printer 100 according to the invention. Lid 101 of printer 100 encloses print carriage 102 in which four print cartridges 105*a*, 105*b*, 105*c*, 105*d* (also known as "pens," printhead cartridges," or "cartridges") are inserted, as explained in more detail below. Print carriage 102 is mounted on slider bar 103 such that a printhead (not shown) on each of print cartridges 105*a*, 105*b*, 105*c*, 105*d* is adjacent print medium 104, e.g., paper.

Print medium 104 is fed from print media input stack 107 in input tray 106 through a print medium feed mechanism (not shown). Print medium 104 is then advanced by rollers (not shown) in a direction perpendicular to slider bar 103 while print carriage 102 is moved back and forth on slider bar 103, as explained in more detail below with respect to FIG. 1C. As the print cartridges 105*a*, 105*b*, 105*c*, 105*d* move relative to print medium 104, ink is ejected through nozzles formed in each of the printheads. Ink is held in a reservoir within each of print cartridges 105*a*, 105*b*, 105*c*, 105*d*. Typically, each of print cartridges 105*a*, 105*b*, 105*c*, 105*d* contains a different color of ink, e.g., black, cyan, magenta, yellow. The ink passes through channels formed in each of print cartridges 105*a*, 105*b*, 105*c*, 105*d* to firing chambers formed in each print cartridge 105*a*, 105*b*, 105*c*, 105*d* in the vicinity of the nozzles. The ink in the firing chamber is heated and vaporized, the vapor bubbles in the ink causing a droplet of ink to be ejected through an associated nozzle onto print medium 104. The nozzles in the printhead of each print cartridge 105*a*, 105*b*, 105*c*, 105*d* are arranged in a pattern, such as a rectangular matrix, and ink selectively ejected onto print medium 104 so that desired characters or other images are printed on print medium 104.

Though, in the description above, the print carriage 102 contains four print cartridges 105*a*, 105*b*, 105*c*, 105*d*, each print cartridge 105*a*, 105*b*, 105*c*, 105*d* containing either black, cyan, magenta or yellow ink, it is to be understood that other numbers of print cartridges can be used, e.g., three print cartridges, and other colors of ink can be used, e.g., red, green and blue. The invention also encompasses, for example, printers including only one print cartridge.

Figure 1B:
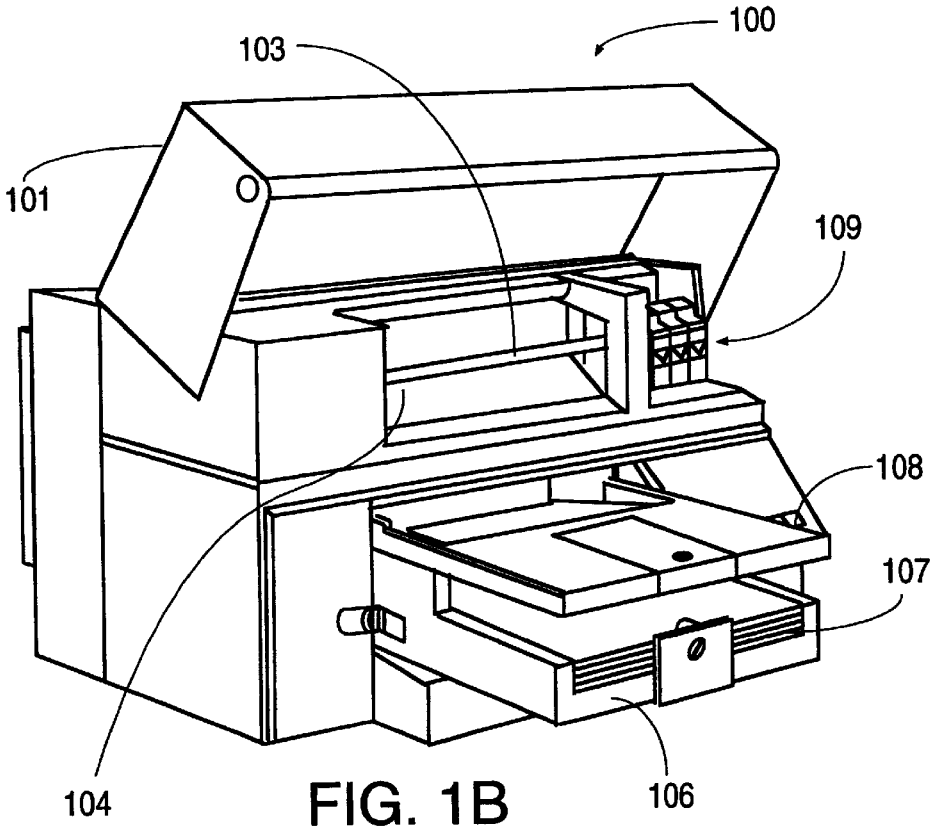
FIG. 1B is a simplified perspective view of the inkjet printer of FIG. 1A illustrating a non-printing mode of operation in which the print cartridges are capped.

As part of operation of printer 100, it is necessary to perform certain maintenance operations on the printheads of the print cartridges 105*a*, 105*b*, 105*c*, 105*d*. FIG. 1B is a simplified perspective view of printer 100 illustrating a non-printing mode of operation in which print cartridges 105*a*, 105*b*, 105*c*, 105*d* are capped in a service station, indicated generally by reference numeral 109. The service station 109 (described in more detail below) is provided in printer 100 for performing print cartridge maintenance operations, which include wiping, priming and spitting, and for storing (capping) print cartridges 105*a*, 105*b*, 105*c*, 105*d* when print cartridges 105*a*, 105*b*, 105*c*, 105*d* are not being used for printing.

Figure 1C:
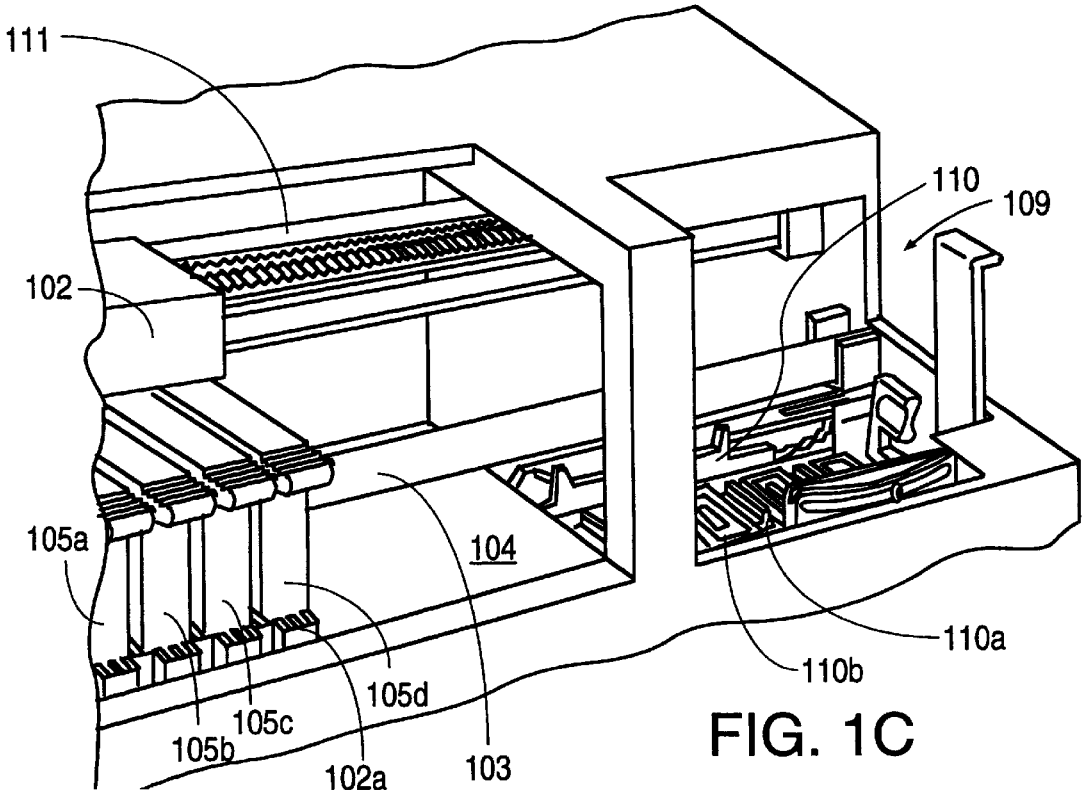
FIG. 1C is a perspective view of a portion of FIG. 1A.

FIG. 1C is a perspective view of a portion of FIG. 1A. Continuous belt 111 is used to drive print carriage 102 along slider bar 103 in a conventional manner. A conventional linear encoder strip (not shown) is utilized, as is known in the art, to detect the position of print carriage 102 as it moves back and forth adjacent print medium 104, so that print carriage 102 can be appropriately positioned during printing. Print carriage 102 is also mounted on a guide rail (not shown) to prevent print carriage 102 from rotating about slider bar 103.

Each of print cartridges 105*a*, 105*b*, 105*c*, 105*d* is held in place in a corresponding stall of print carriage 102 by a friction fit. A resilient arm 102*a* protrudes from a bottom surface of each of the stalls so that each print cartridge 105*a*, 105*b*, 105*c*, 105*d* is fitted into the corresponding stall by "snapping" the print cartridge 105*a*, 105*b*, 105*c* or 105*d* into place such that the corresponding resilient arm prevents the print cartridge 105*a*, 105*b*, 105*c* or 105*d* from moving in a direction perpendicular to slider bar 103. Springs (not shown) are attached to a side of each stall such that when each print cartridge 105*a*, 105*b*, 105*c* or 105*d* is snapped into place in the corresponding stall, the springs are compressed and apply a force to the print cartridge 105*a*, 105*b*, 105*c* or 105*d* to prevent the print cartridge 105*a*, 105*b*, 105*c* or 105*d* from moving laterally (i.e., parallel to slider bar 103) within the stall.

As seen in FIG. 1C, service station 109 includes sled 110 which further includes wipers 110*a* and caps 110*b*. As explained in more detail below, when print cartridges 105*a*, 105*b*, 105*c*, 105*d* are not being used for printing, print carriage 102 is moved to service station 109 and lowered to a capping position such that each print cartridge 105*a*, 105*b*, 105*c*, 105*d* contacts and is surrounded by a corresponding one of a plurality of caps 110*b*. Print cartridges 105*a*, 105*b*, 105*c*, 105*d* are capped when not in use to prevent the nozzles in the printheads from drying out.

A plurality of wipers 110*a* in service station 109 wipe the printheads of print cartridges 105*a*, 105*b*, 105*c*, 105*d* to remove contaminants or crusted ink that may block the printhead nozzles. Each wiper 110*a* wipes only one of print cartridges 105*a*, 105*b*, 105*c* or 105*d* as print carriage 102 moves into or out of service station 109.

Service station 109 is also used for priming. If, for some reason, ink is no longer in the firing chamber adjacent one or more of the nozzles, so that ink is not being ejected from the nozzle, a vacuum can be applied through the nozzle while printer carriage 102 is in the capping position to draw ink from the ink reservoir of the print cartridge 105*a*, 105*b*, 105*c* or 105*d* into the firing chamber.

Service station 109 can also be used for spitting. When print cartridges 105*a*, 105*b*, 105*c* or 105*d* have been capped for a lengthy period of time, before printing again it is necessary to "spit," i.e., eject a series of drops of ink to clear crusted ink from the nozzle. This operation is performed either before, during or after wiping.

FIGS. 2A through 2H are a series of simplified front elevations of an inkjet wiping and capping apparatus (i.e., service station), made in accordance with an embodiment of the invention, showing various phases of the apparatus' operation, as explained in more detail in commonly owned, copending U.S. patent application Ser. No. 07/949,197, entitled "Ink-jet Printhead Capping and Wiping Method and Apparatus," filed by William S. Osborne on Sep. 21, 1992, the pertinent disclosure of which is incorporated by reference herein. FIGS. 2A through 2H show, fragmentarily and in greatly simplified form, an inkjet printer 210 in front elevational view. For the sake of clarity, only FIG. 2A carries all referenced numerical designators.) The printer chassis 212 (base) is shown only fragmentarily and in greatly simplified form. A floating sled 214 is gimbal-mounted to printer chassis 212. A linear array of one or more caps 216 (having printhead-sealing lips at their upper extents) and a like number of wipers 218 (having upper terminal ends or wiping surfaces) is mounted on a generally planar support member 220. Sled 214 is positioned beneath the printer's movable carriage 222, which is shown only fragmentarily. Carriage 222 mounts plural print cartridges (not shown in FIGS. 2A through 2H), the operative bottom surfaces (printheads) of which define a first substantially horizontal plane P indicated in FIGS. 2A through 2H as a dashed line.

Each of wipers 218 is operatively associable with a corresponding print cartridge, as is each cap 216. Sled 214, which is gimbal mounted to chassis 212 by plural spring elements 224, as explained in more detail below, may be seen from FIGS. 2A through 2H to be cam-coupled with chassis 212 for controlled relative movement therebetween. Sled 214 also is cam coupled with carriage 222, on which the print cartridges are mounted, for controlled relative movement therebetween. As will be seen, this dual cam coupling of sled 214 with fixed chassis 212 and movable carriage 222 produces slight vertical and horizontal movement of sled 214 in response to controlled, reciprocal, horizontal movement of carriage 222 relative to chassis 212. Such reciprocal movement of carriage 222 relative to chassis 212, in accordance with the method and apparatus of the invention, is automatically provided by the printer's carriage controller.

In a service mode of operation of printer 210, cam-coupled sled 214 and chassis 212, and cam-coupled sled 214 and carriage 222, responsive to the controller and movement of carriage 222 undergo predetermined vertical and lateral movement that results in the placement of caps 216 and wipers 218 in predefined printing (uncapped), wiping and capping positions relative to their corresponding printheads. A single drive motor for controlling carriage 222 is operated in common with both the service mode described herein and with the normal printing mode of operation of the printer.

Importantly, gimbal mounting of sled 214 to chassis 212, by way of plural spring elements or members 224, produces a substantially constant force between the printheads and caps 216 (for capping) by upward forces imparted through sled 214 normal to plane P. Spring elements 224, with the leaf springs of a wiper structure according to the invention described in more detail below, also produce a substantially constant force between the printheads and wipers 218 (for wiping). Constant-force capping and wiping provided by the structure according to the invention reduces wear on the lips of caps 216 and on the wiping surfaces of wipers 218, each of which may be brought into frequent contact with the printheads of the print cartridges.

Figure 6:
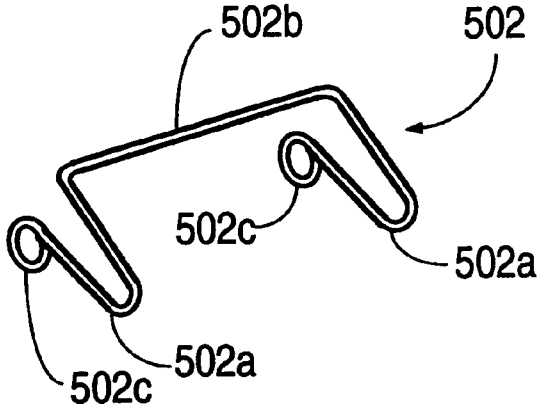
FIG. 6 is a perspective view of a spring used with the service station of FIG. 5.
Figure 5:
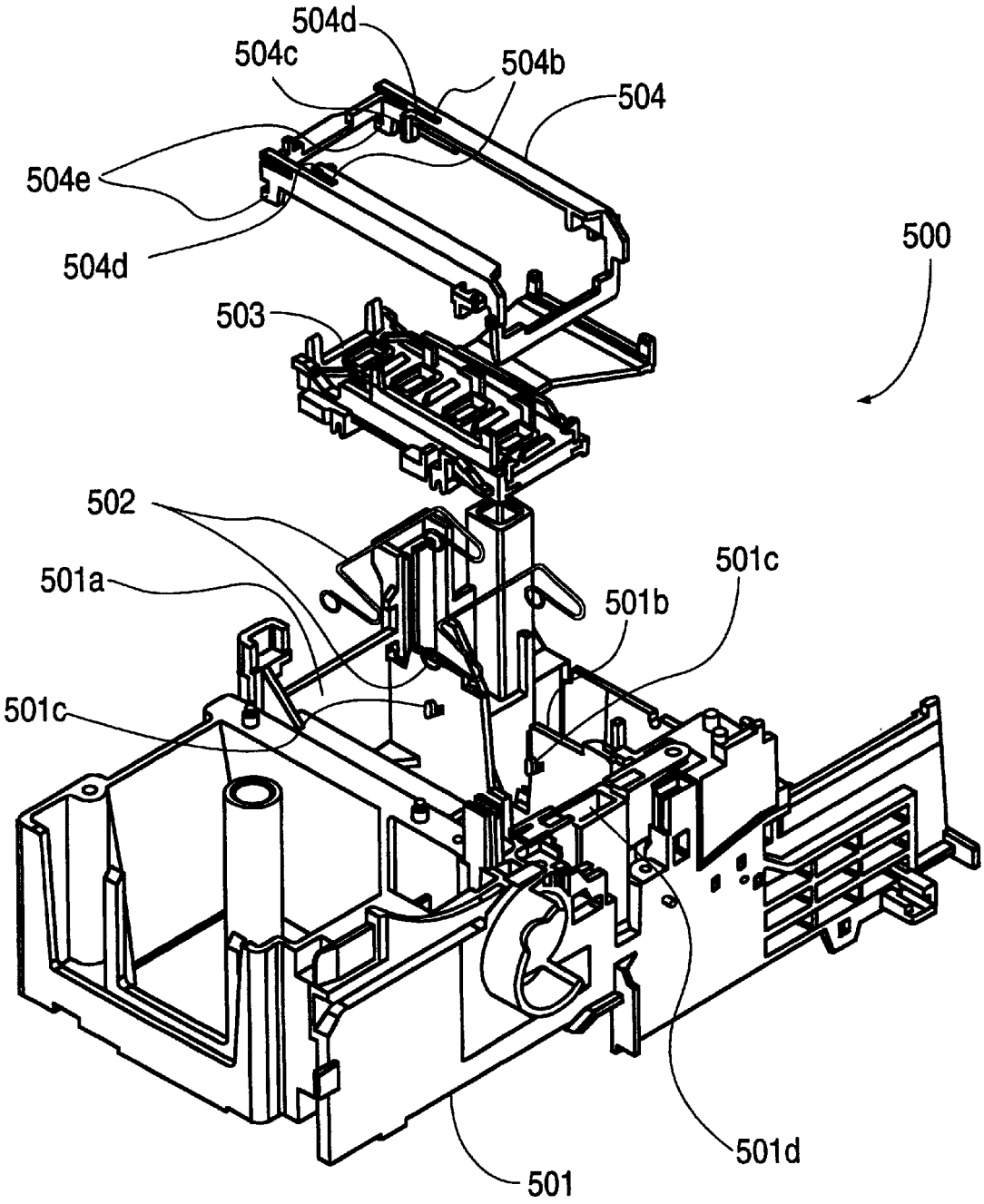
FIG. 5 is an exploded perspective view of a service station for use with an inkjet printer according to the invention illustrating the assembly of the service station.
Figure 10:
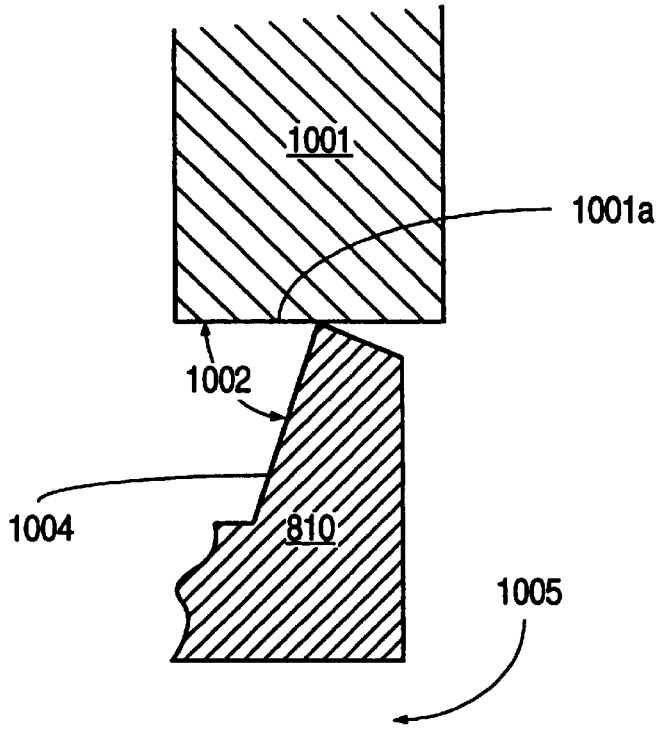
FIG. 10 is a cross-sectional view of the wiper blade of FIGS. 9A and 9B wiping across the printhead of a print cartridge.

Each of spring elements 224 is made of, for instance, spring steel and is mounted rotatably on one end to a capture post (indicated schematically as a simple circle in FIGS. 2A through 2H) on chassis 212 and on the other end to a capture post (identically indicated in FIGS. 2A through 2H) on sled 214. Spring elements 224 are generally V-shaped, as shown, and have a nominal angle between their radially extending arms of approximately 31.9° and provide approximately 0.4 pounds of force (1.8 N) at 10.4 mm (0.409 inches) of compression from their nominal 24.2 mm (0.953 inches) span. In one embodiment, the spring elements 224 are flat leaf springs. In another embodiment, the spring elements 224 are wire springs, as shown in FIGS. 5, 6 and 10, and described in more detail below.

Gimbal-mounting with spring elements 224 also defines a printing position of sled 214 in a substantially horizontal plane that is parallel with plane P defined by the surfaces of the printheads. Stored energy in spring elements 224 provides the force necessary to urge sled 214 through the various vertical and lateral movements that are controlled by the above-described cam-coupling arrangement. Such cam-controlled horizontal and vertical movement of sled 214 relative to chassis 212 thus requires no external motive force, e.g., a dedicated drive motor, but instead is produced very simply and cost effectively by horizontal movement between carriage 222 and chassis 212.

Referring still to FIGS. 2A through 2H, sled 214 includes first cam surfaces 214*a* having predefined, nearly identical, profiles. Left cam surface 214*a* has a pronounced vertical step defining a temporary stop S, whereas right cam surface 214*a* has an inclined corresponding step also defining temporary stop S. Each of first cam surfaces 214*a* are engaged with corresponding second cam follower members 212*a* of chassis 212. Sled 214 further includes first cam follower members 214*b* extending upwardly from sled 214. First cam follower members 214*b* engage with corresponding second cam surfaces 222*a*, 222*b* of carriage 222. Four first cam surfaces 214*a* and first cam follower members 214*b* are provided along the perimeter of generally plano-rectangular sled 214 to horizontally stabilize sled 214, although for reasons of clarity and brevity only two are shown in FIGS. 2A through 2H. Correspondingly, four second cam follower members 212*a* are provided on chassis 212 and two each second cam surfaces 222*a*, 222*b* are provided on carriage 222, although only two and one each, respectively, are shown in FIGS. 2A through 2H.

In another embodiment of the invention, the position of the left and right first cam surfaces 214*a* are reversed, as compared to the embodiment of the invention shown in FIGS. 2A through 2H. In FIG. 3 (which, except for cam surfaces 214*a*, is identical to FIG. 2A), temporary stop S for the right cam surface 214*a* is defined by a pronounced vertical step, and a temporary stop S for the left cam surface 214*a* is defined by an inclined corresponding step.

During the wiping of the printheads, contact of each of the printheads with the corresponding wiper 218 imparts a force to the sled 214. Locating the left and right first cam surfaces 214*a* as shown in FIG. 3 results in more even distribution of these forces over the sled 214, so that the sled 214 is retained better in the wiping position during the wiping of the printheads.

Sled 214 is injection molded from a polymer material having a teflon filler. In order to provide a suitably low coefficient of friction between cam surfaces 214*a* and cam follower members 212*a* of the chassis, cam follower members 212*a* are injection molded parts of the same polymer material without the teflon filler. These materials provide for smooth cam action and durability of the contacting surfaces of sled 214 and chassis 212. Other suitable materials may be used, although lightweight, and easily and inexpensively manufactured parts are preferred.

Figure 2A:
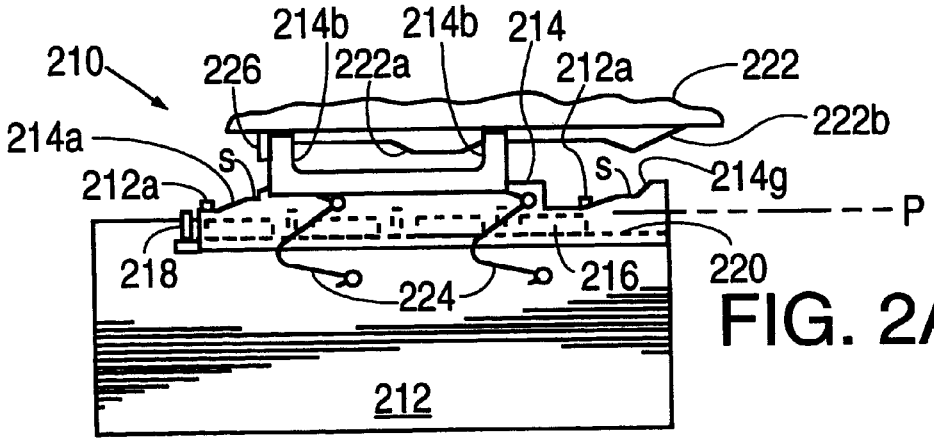
FIGS. 2A through 2H are a series of simplified front elevations of an inkjet wiping and capping apparatus, made in accordance with an embodiment of the invention, showing various phases of the apparatus' operation.
Figure 2B:
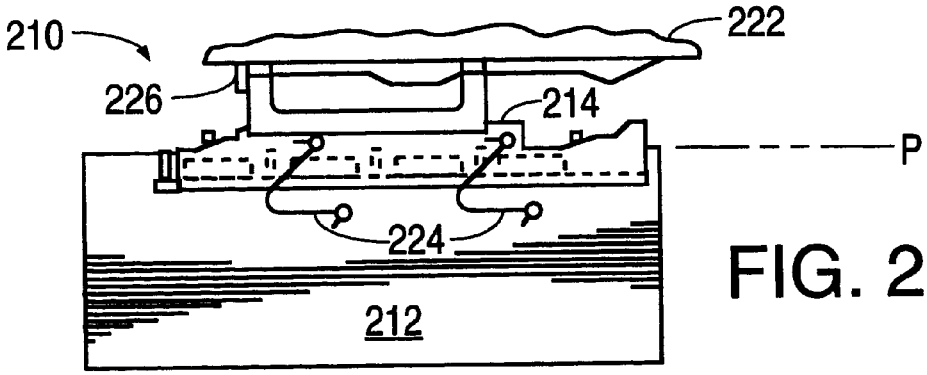
Figure 3:
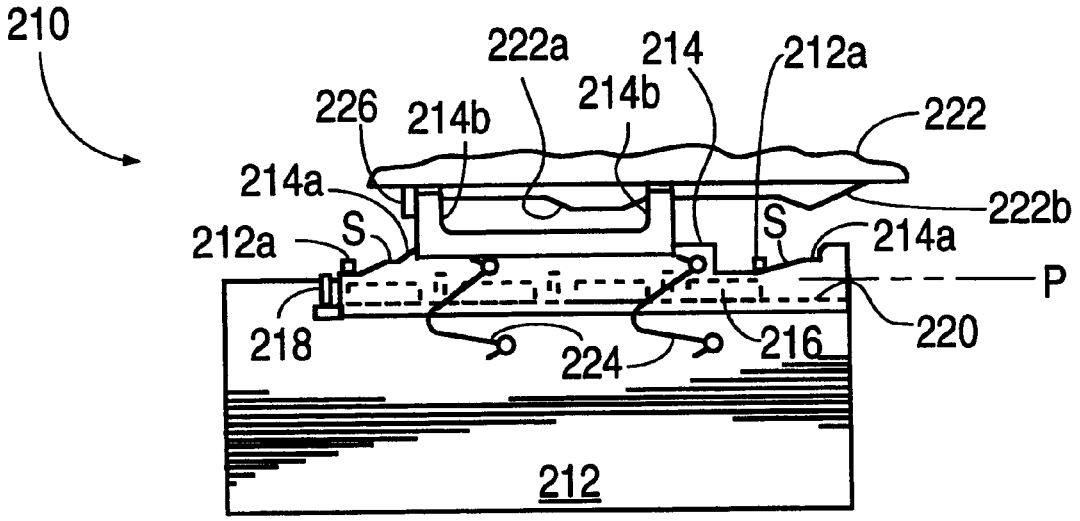
FIG. 3 is a simplified front elevation of an inkjet wiping and capping apparatus, similar to FIG. 2A, made in accordance with another embodiment of the invention.

FIG. 2A illustrates a capping position in which the plane defined by the surfaces of the printheads is, with slight interference fit, coplanar with the plane defined by the lips of caps 216. FIG. 2B illustrates an uncapped position of the printheads in which sled 214 is at an intermediate wiping position or elevation in which the plane P defined by the surfaces of the printheads is, with slight interference fit, coplanar with a plane defined by the wiping surfaces of wipers 218.

As may best be seen by contrasting FIGS. 2A and 2B, the printheads are uncapped by relative movement between chassis 212 and sled 214, with first cam surfaces 214*a* of sled 214 and second cam follower members 212*a* of chassis 212 producing substantially vertical downward movement of sled 214 relative to carriage 222, the relative movement between chassis 212 and sled 214 being produced by an end stop 226 mounted on carriage 212 adjacent an extreme end of second cam surfaces 222*a*, 212*b*. By the dual cam action provided between (1) first cam surfaces 214*a* of sled 214 and second follower members 212*a* of chassis 212, and (2) second cam surfaces 222*a*, 222*b* of carriage 222 and first follower members 214*b* of sled 214, no horizontal movement between sled 214 and chassis 222 occurs, but a downward vertical movement of sled 214 relative to chassis 222 does occur, thereby removing sled 214 from a printhead capping to a printhead wiping position. This downward vertical movement of sled 214 relative to carriage 222 results from forces imparted on sled 214 by the slight leftward movement of carriage 222 as second follower members 212*a* of chassis 212 urge sled 214 downwardly via an upwardly and rightwardly inclined, left-most region of first cam surfaces 214*a* of chassis 212.

Figure 2C:
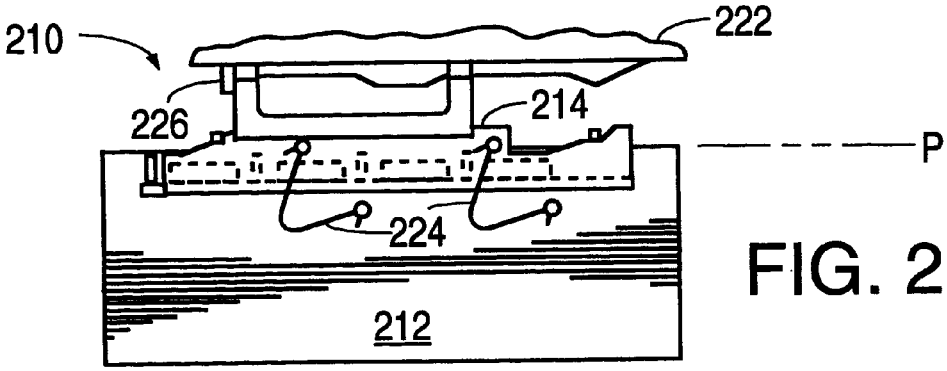
Figure 2D:
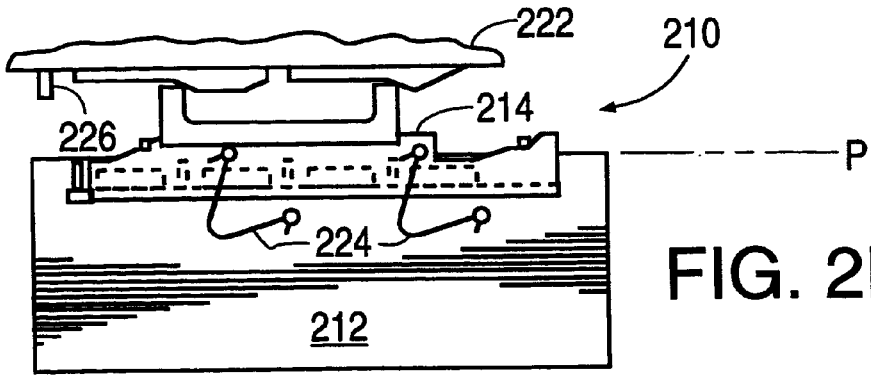

By contrasting FIGS. 2B and 2C, it is seen how sled 214 has moved from the uncapped position of FIG. 2B to a start-of-wipe position of FIG. 2C. In FIG. 2C, carriage 212 is slightly further to the left than in FIG. 2B. In the uncapped position of FIG. 2B, spring elements 224 are compressed. The natural tendency of spring elements 224 to resist compression causes spring elements 224 to open up and thereby cause sled 214 to move slightly further left relative to chassis 212 until second follower members 212*a* reach a temporary stop, indicated as S, approximately half way up inclined first cam surfaces 214*a*. FIGS. 2C and 2D represent what may be referred to as an equilibrium position of sled 214 relative to chassis 212 in which sled 214 will remain at a predefined wiping elevation relative to carriage 222 until carriage 222 is urged out of equilibrium by an external force. FIG. 2C represents a start-of-wipe (or begin-wipe) position and FIG. 2D represents an end-of-wipe position between which the printheads are wiped by substantially horizontal relative movement between carriage 222 and chassis 212.

Figure 2E:
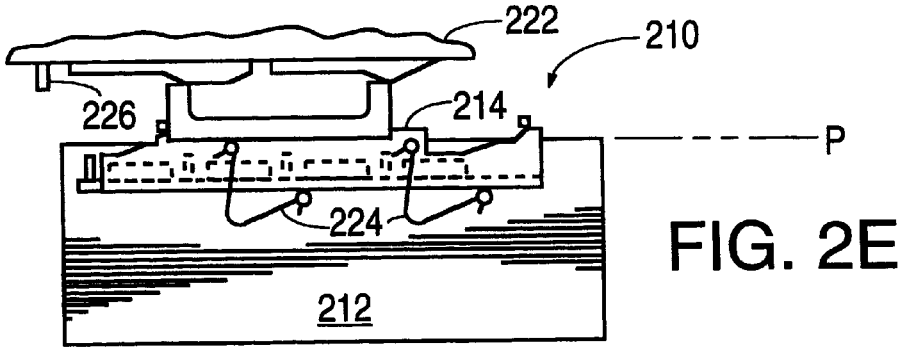

Contrasting FIGS. 2D and 2E, it may be seen that, at the end of the wiping action in which sled 214 is in the above described equilibrium position, second cam surfaces 222*a*, 222*b* of carriage 222 impact first follower members 214*b* of sled 214 to force sled 214 slightly downwardly near the end of the leftward travel of carriage 222. FIG. 2E illustrates a position of sled 214 at which wipers 218 are disengaged from the printheads.

Figure 2F:
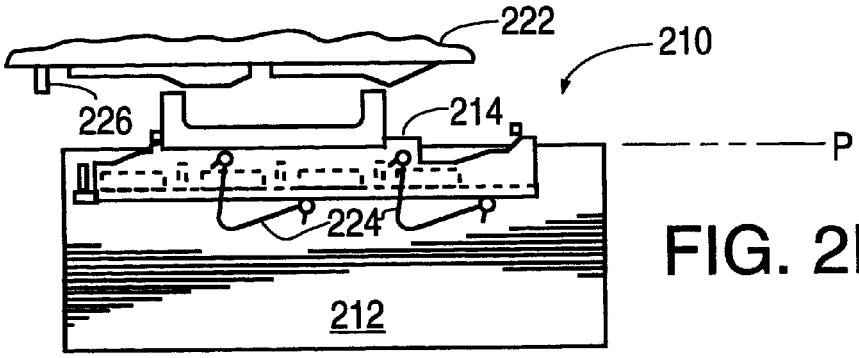

FIG. 2F shows the down position of sled 214 in which carriage 222, freely and without printhead interference with either caps 216 or wipers 218, may be horizontally reciprocated above sled 214.

Figure 2G:
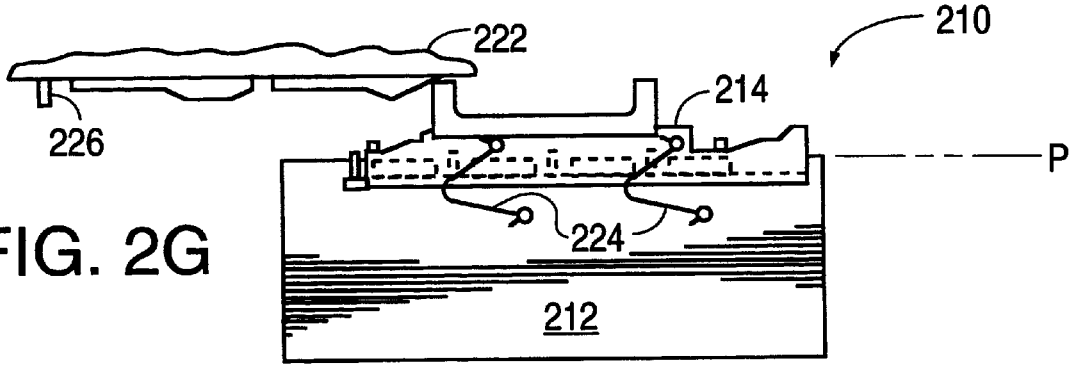
Figure 2H:
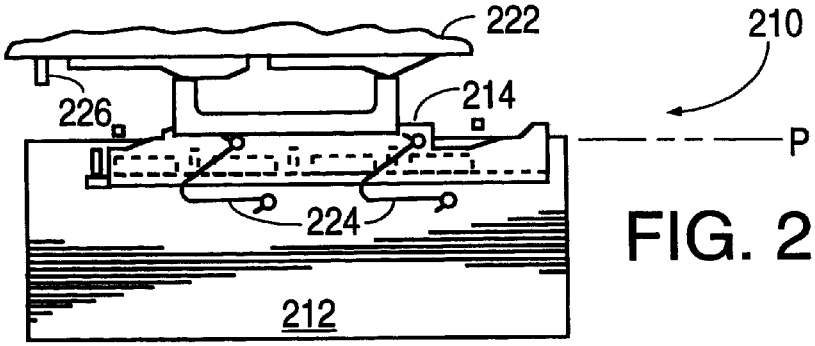

FIG. 2G shows a temporary lockout position of carriage 222 that might be reached by intentional or inadvertent manual intervention by a printer operator or service person. Importantly, the extreme right end of second cam surface 222*b* has a leftwardly, downwardly inclined region that, with first cam follower members 214*b* positioned to the right thereof, but moving toward the left, causes sled 214 to settle into a lowered position in which carriage 222 may freely be returned to the right as in the capping position shown in FIG. 2A. Spring elements 224 under compression in the position of sled 214 shown in FIG. 2H tend to urge sled 214 into the capping position of FIG. 2A as carriage 222 travels toward the right.

The above description of FIGS. 2A through 2H illustrate that relative movement between carriage 222 and base 212 produces downward movement of sled 214 by cam action between first cam surface 214*a* and second follower member 212*a*, which downward movement positions the upper terminal ends of wipers 218 in plane P defined by the surfaces of the printheads, thereby to define a wiping position of sled 214. Further relative movement between carriage 222 and base 212 produces wiping action between wipers 218 and the printheads. Still further relative movement produces further downward movement of sled 214 by cam action between second cam surface 222*a* and first follower member 214*b*, which positions the lips of caps 216 and the upper terminal ends of wipers 218 beneath plane P, thereby defining a free position of sled 214 in which carriage 222 may freely be reciprocated without interference between the printheads and the cap lips or between the printheads and the wipers.

Figure 4:
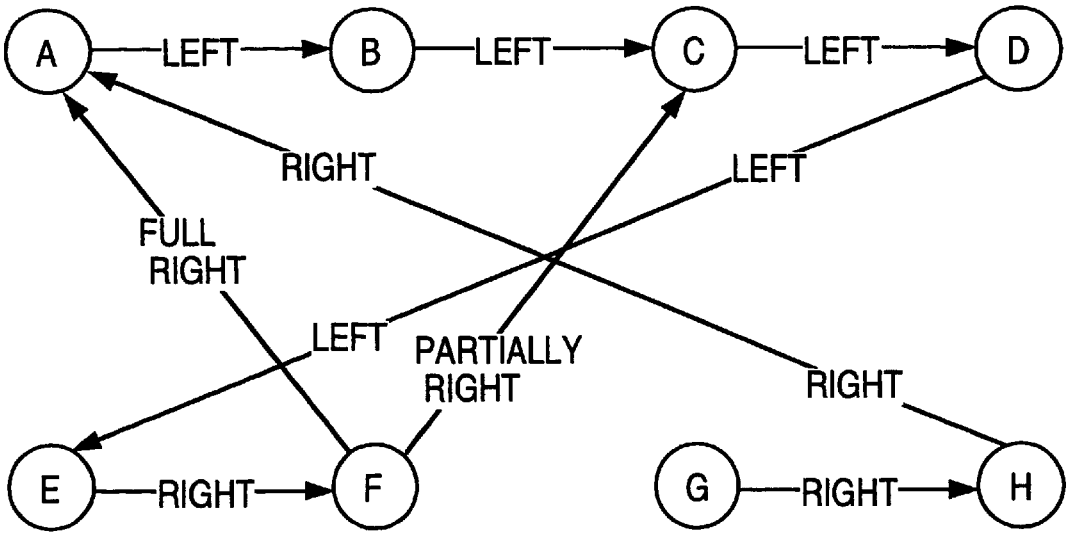
FIG. 4 is a transition diagram corresponding to the operational phases illustrated in FIGS. 2A through 2H.

FIG. 4 is a flow diagram that illustrates the transitions (represented by arrows labelled with the direction of travel of carriage 222 that produces the transition) through which printer 210 progresses to reach the various operational phases A through H (represented by circles so labelled) corresponding, respectively, to FIGS. 2A through 2H. The capping position (A) of sled 214 represents the start of the service mode of operation of printer 210 to which sled 214 may be returned from the down position (F) that normally ends such service mode. Alternatively, when sled 214 is in the down position (F), sled 214 may repeatedly wipe the printheads by transitioning instead to the start-of-wipe position (C) and indefinitely repeating the transition through the start-of-wipe position (C), end-of-wipe position (D), disengage-wipe position (E) and down position (F), as shown.

In the event that printer 210 is in lockout position (G), sled 214 may be moved to a service position by transitioning through an entering-from-lock-out position (H) by moving carriage 222 to the right as shown. First follower members 214*b* glide along leftwardly, downwardly inclined regions of second cam surfaces 222*a*, 222*b* to return sled 214 to the capping position (A). The left one of cam follower members 214*b* is made slightly wider than the right one, and the spaces immediately to the left and right of second cam surface 222*a* also are differently dimensioned, so that left cam follower member 214*b* cannot enter the space between second cam surfaces 222*a*, 222*b* during a transition from the entering-from-lock-out position (H) to the capping position (A).

It is the full or partway extent of rightward carriage travel, as determined by the controller, that determines whether sled 214 transitions from the down position (F) to the capping position (A) or to the start-of-wipe position (C). In other words, carriage 222 is moved either a first amount after first follower member 214*b* hits end stop 226 in order to place sled 214 in the capping position (A), or a second amount, less than the first amount, after first follower member 214*b* hits end stop 226, to place sled 214 in the start-of-wipe position (C).

Carriage-mounted end stop 226 engages first follower member 214*b* to urge sled 214 laterally relative to base 212 in response to rightward movement of carriage 212 by the controller. Thus, with sled 214 in the down position (F), in which carriage 222 freely may be reciprocated thereabove, and with such first amount of movement by carriage 222, end stop 226 stops first follower member 214*b* thereby producing movement between first cam surface 214*a* and second follower member 212*a* sufficient to elevate sled 214 to the capping position (A). Alternatively, with sled 214 in the down position (F) and with such second amount of movement, end stop 226 stops follower member 214*b* thereby producing movement between cam surface 214*a* and follower member 212*a* sufficient only to elevate sled 214 to the start-of-wipe position (C).

The method of the invention may now be understood, in view of the above description of an apparatus according to the invention. The method of uncapping and wiping an inkjet printer's printhead, wherein the printhead is part of a print cartridge that is fixedly mounted on a movable carriage of the printer, includes: (1) providing a sled-mounted wiper selectively engageable with the printhead, e.g., wiper 218 mounted on sled 214; (2) providing the sled with a cam surface, e.g., first cam surface 214*a*, for engaging a corresponding cam follower member, e.g., follower member 212*a*, mounted on the printer's chassis; (3) spring-mounting such sled on such chassis, e.g., by way of spring elements 224; (4) moving the carriage horizontally relative to such chassis, thereby producing vertical movement between the sled and the carriage by cam action to uncap the printhead and to position the wiper in a plane defined by the printhead, e.g., controlling the movement of carriage 222 to cause sled 214 and wiper 218 mounted thereon to leave the capping position (A) and to move to the uncapped position (B); (5) next moving the carriage horizontally relative to the chassis, thereby producing horizontal movement of the sled parallel with such plane in such manner that the printhead is wiped by the wiper in a given direction defined by such relative movement, e.g., controlling the movement of carriage 222 from the start-of-wipe position (C) to the end-of-wipe position (D) to cause sled-mounted wiper 218 to wipe the printhead in the illustrated left-to-right direction; (6) thereafter lowering the sled to position the wiper below such plane, e.g., into the down position (F); and (7) next moving the carriage horizontally relative to the chassis to restore the printhead to a capping position, e.g., moving carriage 222 fully to the right such that left follower member 214*b* impacts on end stop 226 to force sled 214 back into the capping position (A). Optionally, the method may include repeating the second moving step (step 5), as illustrated in FIG. 4 by moving through steps C, D, E, F, C, D, E, F, etc.

While the above method is described as involving the uncapping, capping and optional recapping of a singular printhead, in accordance with the apparatus according to the invention, the printer may have plural printheads and plural corresponding wipers and caps, whereby all printheads are uncapped, wiped and capped in accordance with the method of the invention. The method and apparatus according to the invention are compatible with printhead spitting, simultaneously with or closely proximate in time with, wiping. The method and apparatus according to the invention are compatible with printhead priming, performed in accordance with the above-referenced U.S. patent application Ser. No. 07/949,318.

The wiping and capping method and apparatus according to the invention enable automatic servicing of the inkjet's printheads, providing uni-directional wiping of each printhead by a separate wiper to avoid printhead re-contamination or inter-printhead contamination. Printhead capping, which greatly extends the life of an inkjet printer, is done under constant force on, rather than under constant deflection of, the caps' sealing lips. Few, relatively simple parts are required and provide a relatively low-cost service station, while avoiding the cost of additional drive motors. This is made possible by gimbal-mounting the sled, on which the caps and wipers are mounted, to the printer's chassis and by variously positioning the sled by dual cam action between the sled and the chassis, and between the sled and the carriage. Controlled reciprocal, horizontal movement of the printer's carriage moves the sled through various positions to uncap, wipe, (repeatedly, as needed) and recap the printheads. The wiping and capping method according to the invention require no operator intervention, take the printer off-line for only a brief time, and automatically restore the printer from the service mode to the printing mode of operation.

FIG. 5 is an exploded perspective view of a service station 500 for use with an inkjet printer according to the invention, illustrating the assembly of the service station 500. Various elements of service station 500 are described in detail in commonly owned, copending U.S. patent application Ser. No. 08/056,327, entitled "Service Station for Inkjet Printer Having Reduced Noise, Increased Ease of Assembly and Variable Wiping Capability," by Heinz H. Waschhauser et al., filed on Apr. 30, 1993, and U.S. patent application Ser. No. 08/055,616, entitled "Service Station for Inkjet Printer Having Improved Wiping," by Heinz H. Waschhauser et al., filed on Apr. 30, 1993, the pertinent disclosures of which are incorporated by reference herein.

Springs 502 are mounted within a hole formed in printer chassis 501. For clarity, only a portion of chassis 501 is shown in FIG. 5. Sled 503 is mounted on springs 502 such that sled 503 is positioned partially within the hole formed in the chassis 501. Cam holder 504 is secured to chassis 501 over sled 503, pressing sled 503 down so that springs 502 are compressed.

As described above, a print carriage (not shown) is cam-coupled to sled 503. Additionally, cam holder 504 (considered part of chassis 212 in the description of FIGS. 2A through 2H) is cam-coupled to sled 503. This dual cam-coupling operates as described above with respect to FIGS. 2A through 2H, 3 and 4 to move sled 503 vertically and horizontally to one of three positions in response to movement of the print carriage. In the capping position, sled 503 is moved laterally as far as possible to the right and out of the plane of FIG. 5, so that sled 503 is raised to a highest position. In the printing position, when the print carriage is free to move without contacting any part of sled 503, sled 503 is moved laterally as far as possible to the left and into the plane of FIG. 5, so that sled 503 is lowered to a lowest position. In the wiping position, sled 503 is positioned between the capping and printing positions, both laterally and vertically.

Each of springs 502 is made of a material and shaped so that springs 502 have a desired spring constant such that sled 503 is biased against cam holder 504 by a force of a desired magnitude and such that, during operation of the printer, the vibrations of sled 503 are maintained below a desired magnitude. Illustratively, springs 502 are made of a metal such as steel. Illustratively, springs 502 are made so that the spring constant of springs 502 yields approximately 0.4 pounds of force (1.8 N) when springs 502 are compressed in the capping position. Generally, the force imparted by springs 502 is of a magnitude sufficient to ensure that sled 503 is held securely in place while in any of the three sled positions: capping position, printing position and wiping position.

Spittoon 501*d* is formed in chassis 501. As explained in more detail below, some or all of the print cartridges can be spitted at various times to clear contaminants from the nozzles of the printhead or to wet the surface of the printhead prior to wiping. When a print cartridge is spitted, the print cartridge is positioned over spittoon 501*d* so that the ink dispensed from the print cartridge collects in spittoon 501*d*.

FIG. 6 is a perspective view of one of springs 502. Each of springs 502 is a wire spring including two substantially parallel V-shaped sections 502*a* connected at the end of one leg of each of V-shaped sections 502*a* by connecting section 502*b*. The nominal angle between the legs of each of V-shaped sections 502*a* is 36°. The end of the other leg of each of the V-shaped sections 502*a* is formed into looped section 502*c*.

Returning to FIG. 5, each of springs 502 is mounted within the hole in chassis 501 by fitting looped sections 502*c* formed on opposing ends of each spring 502 around corresponding protrusions 501*c* (only two of four are shown in FIG. 5) formed on opposing walls of the hole in printer chassis 501. Each spring 502 is oriented so that the leg of each V-shaped section 502*a* connected to connecting section 502*b* is above corresponding looped section 502*c*. Sled 503 is then mounted on springs 502 by fitting the connecting section 502*b* of each spring 502 into a corresponding slot (not visible in FIG. 5) formed in the bottom of sled 503.

Figure 7A:
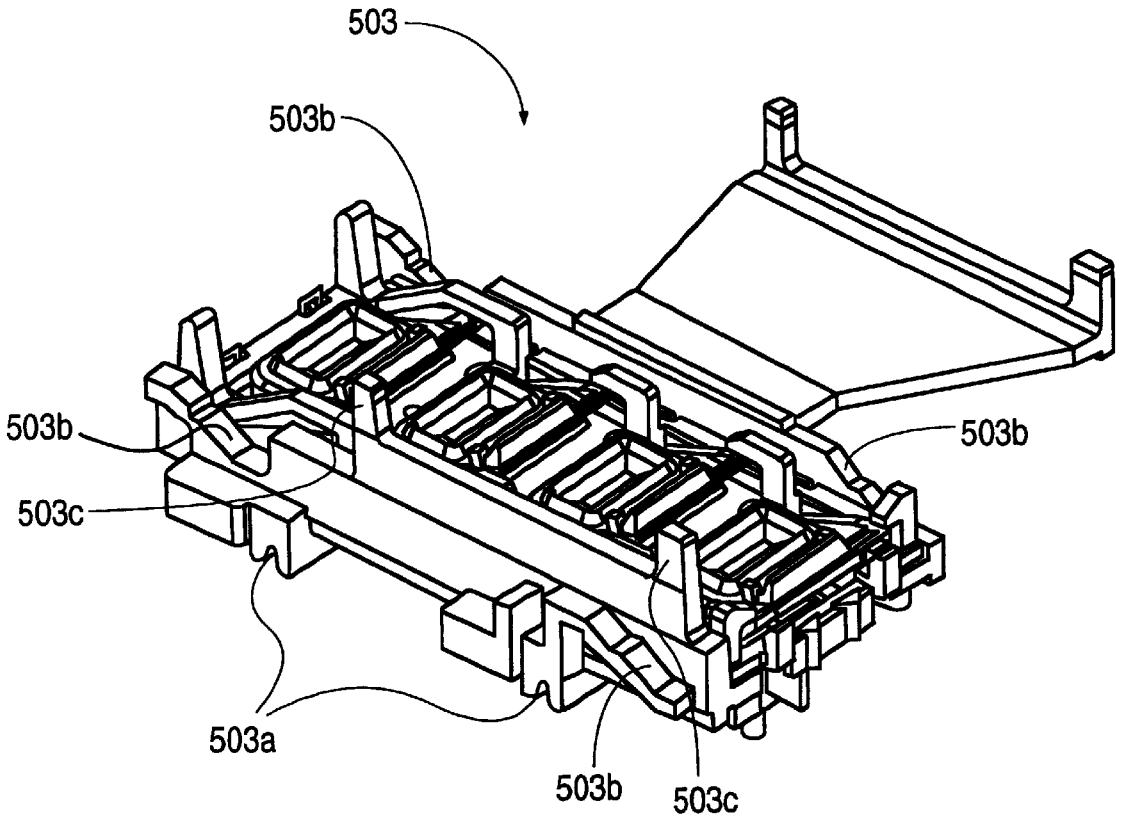
FIG. 7A is a perspective view of the sled of the service station of FIG. 5.

FIG. 7A is a perspective view of sled 503 of service station 500 of FIG. 5. As described above, connecting sections 502*b* of springs 502 are fitted into slots 503*a* (not shown in FIG. 5). Sled 503 includes sled cam surfaces 503*b*. Sled cam surfaces 503*b* correspond to cam surfaces 214*a* of FIG. 3. Sled 503 also includes sled cam follower extensions 503*c*. Sled cam follower extensions 503*c* correspond to first cam follower members 214*b* of FIG. 3.

Figure 7B:
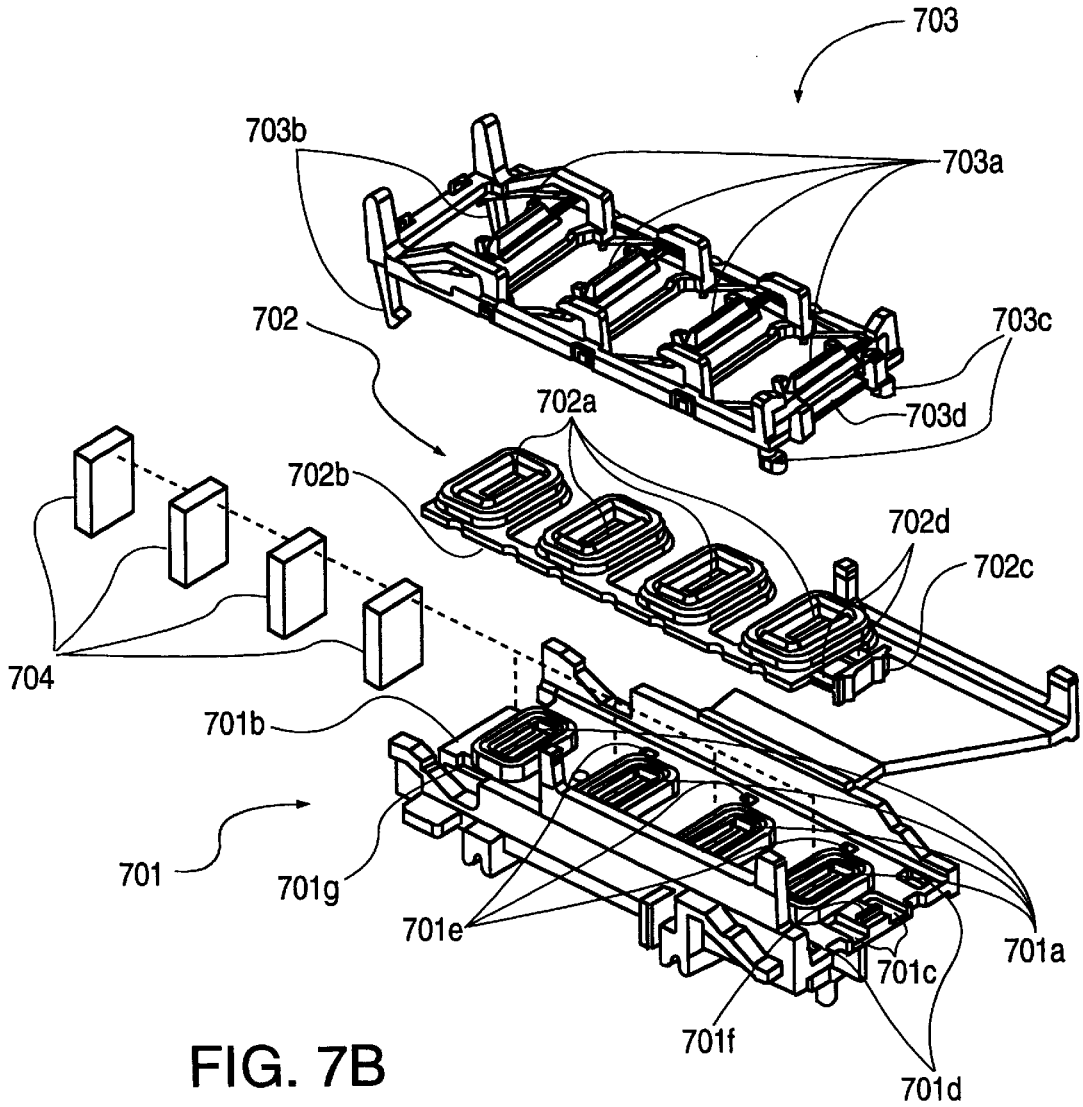
FIG. 7B is an exploded perspective view of the sled of FIG. 7A illustrating the assembly of the sled.

FIG. 7B is an exploded perspective view of sled 503 illustrating the assembly of sled 503. Sled 503 includes sled body 701, cap structure 702, wiper structure 703 and filters 704. Cap structure 702 includes four caps 702*a* connected by cap connecting bar 702*b* to form an integral structure. Wiper structure 703 includes four wipers 703*a*. When cap structure 702 and wiper structure 703 are mounted on sled body 701, a row of caps 702*a* and wipers 703*a* is formed, caps 702*a* and wipers 703*a* located in alternating positions.

Cap structure 702 is made of, for instance, rubber. In one embodiment, cap structure 702 is EPDM rubber having a hardness between durometer 40–66 Shore A with a tolerance of 5 Shore. Other materials could be used, e.g., rubber-like plastics such as polyurethane, kraton or terathane.

Bumper 702*c* is formed at one end of cap structure 702, attached to each of two projecting arms 702*d* extending from the remainder of cap structure 702. Projecting arms 702*d* fit into recesses 701*c* formed in sled body 701 so that bumper 702*c* projects from one end of sled body 701. Bumper 702*c* includes two bumps, each bump having a triangular cross-section. Other numbers of bumps can be used and the bumps can have other cross-sectional shapes, such as circular. Typically, bumper 702*c* and projecting arms 702*d* are integral with the remainder of cap structure 702. Consequently, bumper 702*c* is typically made of the same material as the remainder of cap structure 702. Other sufficiently deformable material can be used.

Bumper 702*c* helps reduce the noise associated with operation of service station 500. When sled 503 moves to the printing position, sled 503 strikes chassis 501. The presence of bumper 702*c* cushions the impact of sled 503 against chassis 501, thereby reducing the noise produced by the impact.

Additionally, as seen in FIG. 5, cam holder 504 is formed with slots 504*b* on each side of cam holder 504 near cam holder cam follower extensions 504*c* (corresponding to second cam follower members 212*a* of FIG. 3). When sled 503 is moved to the wiping position, sled cam surfaces 503*b* strike the cam holder cam follower extensions 504*c*, thereby generating noise. The presence of slots 504*b* imparts more flexibility to the extended sections 504*d* of cam holder 504 from which cam holder cam follower extensions 504*c* extend. Thus, upon impact of sled cam surfaces 503*b* with cam holder cam follower extensions 504*c*, extended sections 504*d* bend slightly, absorbing some of the impact force and reducing the noise generated by the impact.

Returning to FIG. 7B, one of filters 704 is placed in a cavity formed below each cap mount 701*a*. Filters 704 are retained in the cavity by the walls of the cavity and the corresponding cap 702*a*. Filters 704 absorb ink during priming of the print cartridges so that the tubing to the primer does not become clogged with ink.

Figure 8:
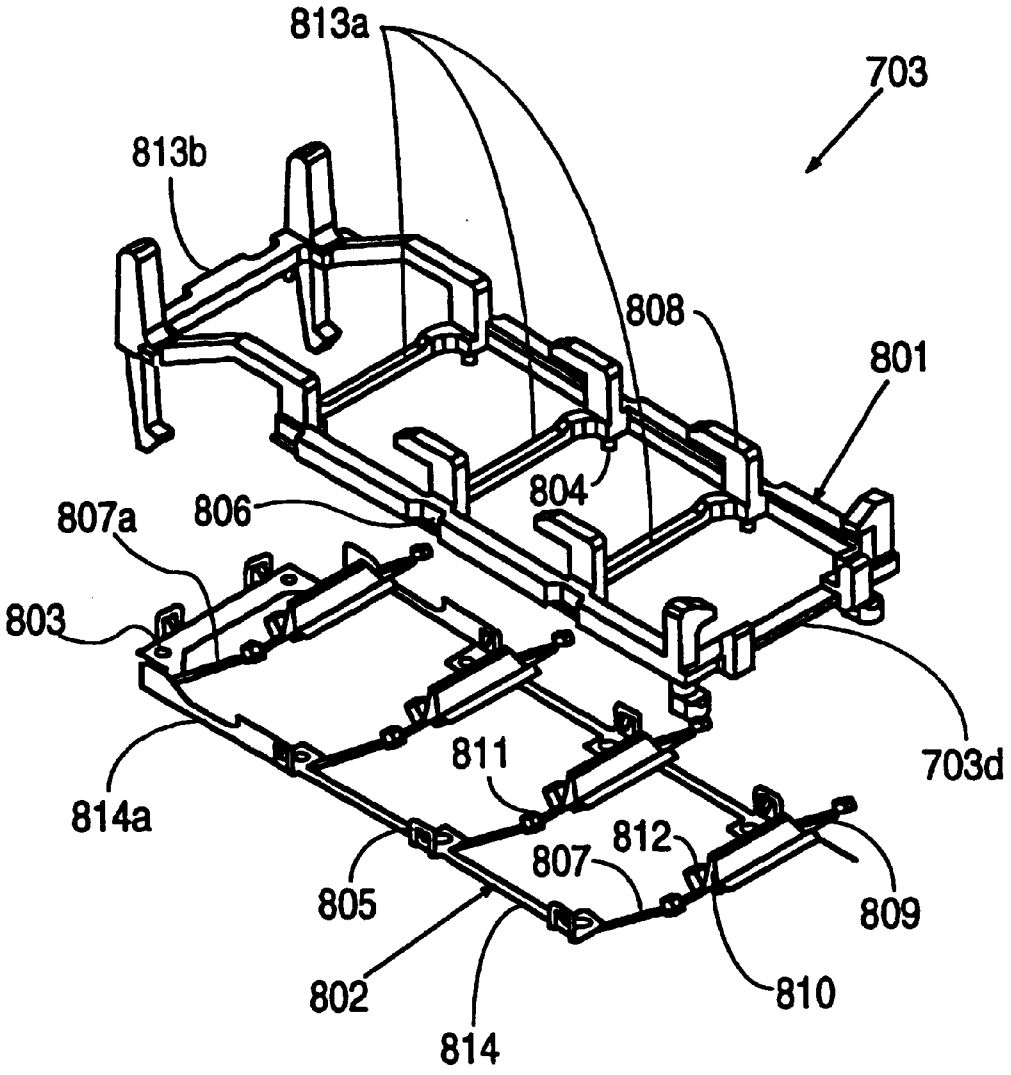
FIG. 8 is an exploded perspective view of a wiper structure according to the invention.

FIG. 8 is an exploded perspective view of wiper structure 703. Wiper structure 703 includes wiper frame 801 and wiper mount 802. Wiper frame 801 is made of, for instance, a plastic such as polycarbonate. Wiper mount 802 is made of, for instance, a metal such as stainless steel.

A plurality of holes 803 are formed along each side of wiper mount 802 (only holes 803 on one side of wiper mount 802 are visible in FIG. 8). Corresponding mounting pins 804 are formed on the underside of wiper frame 801. When wiper structure 703 is assembled, holes 803 of wiper mount 802 fit over mounting pins 804 of wiper frame 801, so that wiper mount 802 is properly aligned with respect to wiper frame 801.

Proximal to each of holes 803 on wiper mount 802 is a clip 805. Each clip 805 includes a tongue formed within a recess. Corresponding shelves 806 are formed on the sides of wiper frame 801. When wiper structure 703 is assembled, the tongue of each clip 805 fits over the edge of corresponding shelf 806 so that wiper mount 802 is held in place with respect to wiper frame 801.

Wiper frame 801 includes connecting bars 813*a* and connecting bar 813*b* that, along with connecting bar 703*d*, discussed in more detail below, connect opposite sides of wiper frame 801. Connecting bars 813*a* and 813*b* are shaped to provide adequate structural integrity of wiper frame 801, and to provide a stop for wiper mount section 809*a* (see FIGS. 9A and 9B below) of each cross member 809 when wipers 703*a* are deflected during wiping. Connecting bar 703*d* is also shaped to provide adequate structural integrity and to restrain wiper structure 703 in a direction parallel to the surface of sled body 701 on which wiper structure 703 is mounted.

Wiper mount 802 further includes a plurality of leaf springs 807 formed integrally with the remainder of wiper mount 802 along each side of wiper mount 802. Each of leaf springs 807 extends from a location proximal to one of holes 803, and is bent so that, when wiper structure 703 is assembled, leaf springs 807 extend in a direction toward a corresponding one of retainers 808 formed on wiper frame 801.

Figure 9A:
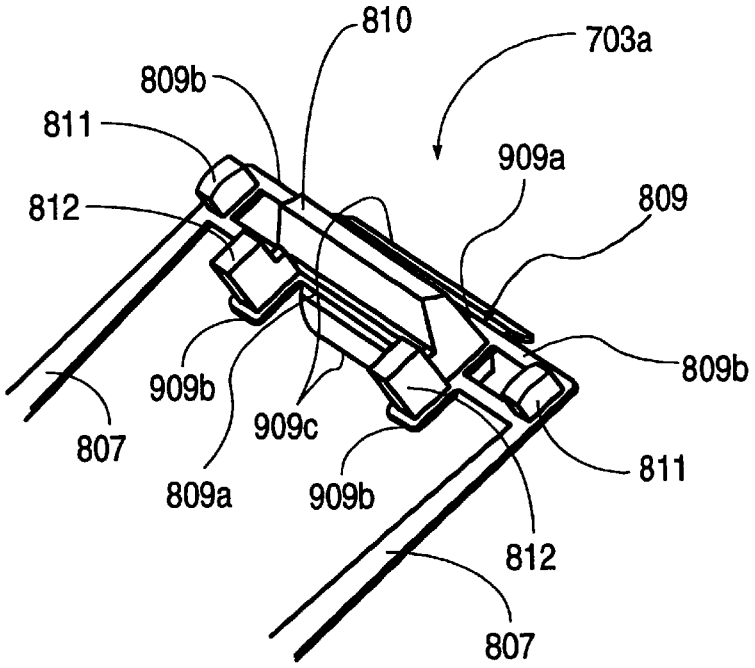
FIGS. 9A and 9B are detailed perspective views of a portion of the wiper mount of FIG. 8.
Figure 9B:
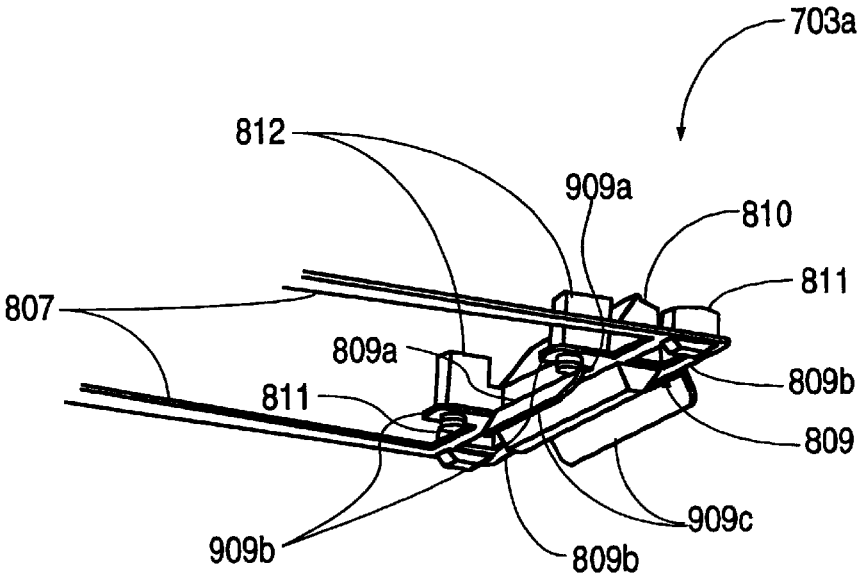
Figure 9C:
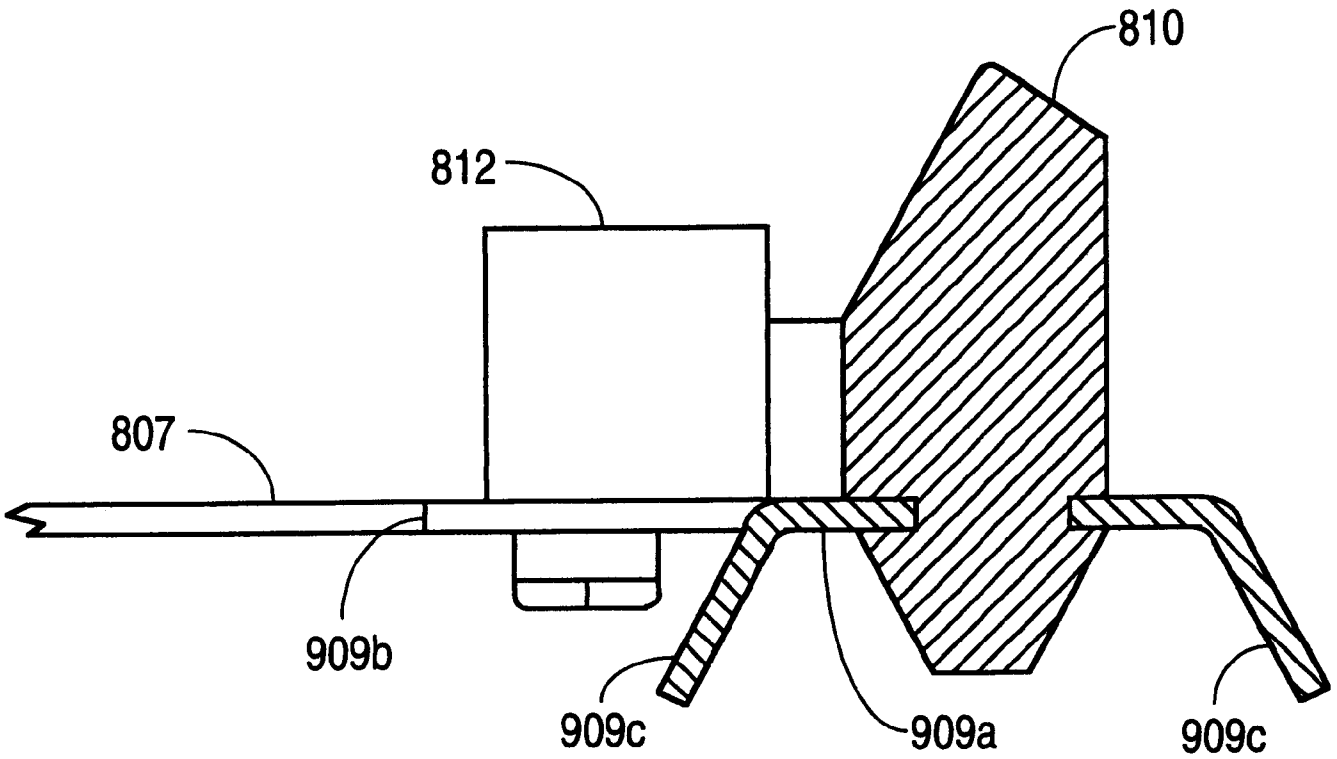
FIG. 9C is a cross-sectional view of a portion of the wiper mount of FIG. 8.

FIGS. 9A and 9B are detailed perspective views of a portion of wiper mount 802. FIG. 9C is a cross-sectional view of a portion of wiper mount 802. Each of a plurality of cross members 809 connects a pair of leaf springs 807 formed on opposite sides of wiper mount 802. Each of cross members 809 includes a centrally formed wiper mount section 809*a* that is connected on either side to a corresponding leaf spring 807 by one of connecting sections 809*b*. One of wipers 703*a* is formed on wiper mount section 809*a* of each cross member 809.

FIG. 10 is a simplified cross-sectional view of wiper blade 810 wiping across printhead 1001*a* of print cartridge 1001. Wiper structure 703 is formed such that each wiper blade 810 has a wiper blade angle of attack 1002 of approximately 75° or more. The exact wiper blade angle of attack 1002 is defined by the slope of surface 1004 of wiper blade 810, the angular orientation of wiper blade 810 with respect to printhead 1001*a* in the direction shown by rotational arrow 1005, and the bending of wiper blade 810.

As described in more detail below, wipers 703*a* are made of a relatively stiff material so that wiper blades 810 of wipers 703*a* bend little during wiping. Thus, the bending of wipers 810 contributes negligibly to wiper blade angle of attack 1002.

When wiper 703*a* is not wiping, the angular orientation of wiper blade 810 is defined by the geometry of leaf springs 807 and the positioning of retainers 808 (FIG. 8) with respect to leaf spring cushions 811 (described below in more detail). When wiper 703*a* is not wiping, wiper blade angle of attack 1002 is somewhat greater than 75°.

Given the positioning tolerances associated with the manufacture of a printer including wiper structure 703, a nominal amount of interference between wiper blade 810 and print cartridge 1001 is specified in order to ensure that wiper blade 810 contacts printhead 1001*a* during wiping. Thus, when wiping begins, wiper 703*a* contacts print cartridge 1001 and is forced underneath print cartridge 1001 (down in FIG. 10) so that wiper blade 810 rotates in the direction of rotational arrow 1005, thereby decreasing wiper blade angle of attack 1002 by a small amount. The slope of surface 1004, the geometry of leaf springs 807 and the positioning of retainers 808 with respect to leaf spring cushions 811, i.e., the wiper blade angle of attack 1002 when wiper 703*a* is not wiping, are specified so that the wiper blade angle of attack 1002 remains greater than or equal to 75° during wiping.

Leaf springs 807 bias wipers 703*a* toward the print cartridges 1001. As noted above, because of the interference between wiper blades 810 and corresponding print cartridges 1001, wiper blades 810 collide with the side of print cartridges 1001 at the beginning of wiping. Since wiper blades 810 are stiff, without the presence of leaf springs 807, large forces would build up between wiper blades 810 and the corresponding print cartridges 1001, resulting in movement of one or more of the print cartridges 1001 from the print carriage or stalling of the motor that drives the print carriage. However, flexible leaf springs 807 allow wiper blades 810 to be pushed down to pass over the printhead 1001*a* during wiping. Further, the spring force from leaf springs 807 maintains good contact between wiper blades 810 and printheads 1001*a*.

Molding wiper blades, e.g., wiper blades 810, onto a spring structure, e.g., wiper mount 802 including leaf springs 807, enables the material properties of the wiper blades to be decoupled from the wiping force and wiper blade angle of attack associated with the wiper blades. Deflection of the spring structure allows a stiff material to be used for the wiper blades so that the wiper blades will deflect only a negligible amount during wiping. Consequently, the wiping force and the wiper blade angle of attack can be made independent of the particular wiper material.

Figure 11:
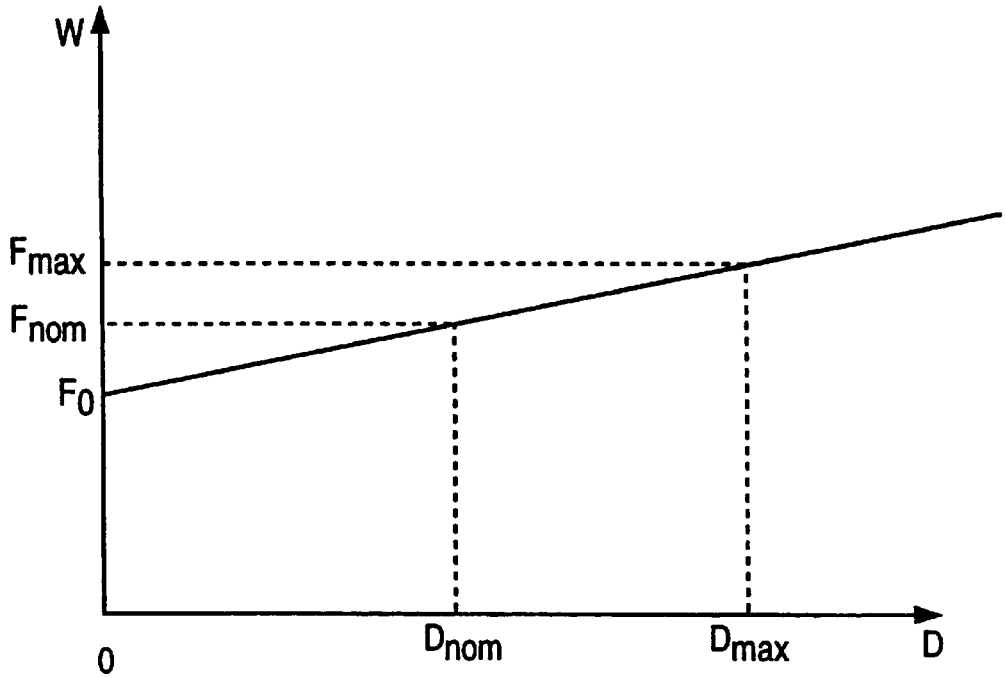
FIG. 11 is a graph illustrating wiping force as a function of linear deflection from a rest position of springs according to the invention on which wipers are mounted.

FIG. 11 is a graph illustrating wiping force F as a function of linear deflection D of leaf springs 807 from a "rest" position. As explained in more detail below, the wiping force associated with a black ink printhead is greater than the wiping force associated with color ink printheads. However, though the force magnitudes may differ, the relationship illustrated in FIG. 11 holds for each leaf spring 807 in wiping structure 703.

The deflection D of each leaf spring 807 is zero when leaf spring cushions 811 of leaf spring 807 rest against retainers 808, i.e., when leaf springs 807 are in the rest position, as described in more detail below. However, as also described below, each of leaf springs 807 is preloaded so that a non-zero wiping force $F_0$ is exerted when deflection D is zero. Since wiper structure 703 and print cartridges 1001 are assembled to ensure that leaf springs 807 are deflected from the rest position, this preload represents a minimum wiping force.

As shown in FIG. 11, leaf springs 807 exhibit a linear relationship between deflection and force. The actual wiping force that each wiper blade 810 applies against printhead 1001*a* is dependent on the preload (force $F_0$) of the particular wiper blade 810, the amount (deflection D) by which the particular wiper blade 810 is deflected from the rest position (i.e., non-wiping position) of wiper blade 810, and the spring constant (slope of the force/deflection line) of the particular leaf spring 807. Print cartridges 1001 and corresponding wiper blades 810 are assembled to yield a nominal deflection $D_{nom}$ of each leaf spring 807 and, thus, a nominal wiping force $F_{nom}$ of wiper blades 810 against the corresponding print cartridges 1001.

Variations in the height of sled 701 (FIG. 7B) with respect to printheads 1001*a* can result in differences in deflection of wiper blades 810 from the nominal deflection $D_{nom}$. If the spring constant of leaf springs 807 is made large enough to ensure adequate wiping force for possible deflections D less than the nominal deflection $D_{nom}$, the wiping force F may be too large for possible deflections D that are larger than the nominal deflection $D_{nom}$. However, if the spring constant of leaf springs 807 is made small enough to acceptably minimize the variations in wiping force F for the possible variations in deflection D from the nominal deflection $D_{nom}$, a minimum necessary wiping force F may not be maintained.

According to the invention, the springs 807 are preloaded with a minimum wiping force $F_0$ of a magnitude such that leaf springs 807 can have a low spring constant and still provide wiping force F of sufficient magnitude to enable effective wiping of the print cartridge printheads 101*a*. Further, since leaf springs 807 have a low spring constant, wiping force on individual printheads 1001*a* varies little despite differences in deflection of wiper blades 810 that can result from, for instance, tolerances associated with the assembly of print cartridges 1001 with respect to sled 701. According to one embodiment of the invention, the spring constant of each of leaf springs 807 is chosen such that the maximum wiping force $F_{max}$ at the maximum possible deflection $D_{max}$ of leaf spring 807 is less than or equal to 40% greater than the minimum wiping force $F_0$ (i.e., preload) when leaf spring 807 is in the rest position.

Though other numbers of print cartridges and other ink colors can be used, in the description above, four print cartridges are used, each print cartridge containing one of four ink colors: black, cyan, magenta and yellow. In contrast to the dye used in color inks, e.g., cyan, magenta, yellow, black ink is formed with pigment. Since pigment does not dissolve as dyes do, the nozzles of black ink print cartridges are more susceptible to ink crusting than the nozzles of color print cartridges. Consequently, it is desirable that the wiper used to wipe the black ink print cartridge printhead be more robust than the wipers used to wipe color ink cartridge printheads.

Therefore, in one embodiment of the invention, leaf springs 807*a* associated with wiper blade 810 that wipes a black ink printhead are made with a spring constant that is greater than the spring constant of leaf springs 807 that are associated with other wiper blades 810, i.e., leaf springs 807*a* are stiffer than the other leaf springs 807, in order to provide more robust wiping of the black ink printhead. This can be done by, for instance, making leaf springs 807*a* wider than the remainder of leaf springs 807, as shown in FIG. 8. This can also be done by making leaf springs 807*a* thicker or shorter than the remainder of leaf springs 807. In one embodiment of the invention, leaf springs 807*a* are made approximately twice as wide as other leaf springs 807. In yet another embodiment, leaf springs 807 have a spring constant of approximately 18 grams force/mm, while leaf spring 807*a* has a spring constant of approximately 34 grams force/mm.

Alternatively, greater wiping force on a black ink printhead can be obtained by making the preload of wiper blade 810 associated with the black ink printhead greater than the preload on other wiper blades 810 and using the same leaf springs 807 for each wiper blade 810.

Illustratively, in one embodiment of the invention, for color ink printheads, the minimum wiping force $F_0$ (preload) is 80 grams force, the nominal deflection $D_{nom}$ is 1.0 mm and nominal wiping force $F_{nom}$ is 98 grams force, and the maximum deflection $D_{max}$ is approximately 3.0 mm and maximum wiping force $F_{max}$ is 134 grams force. Illustratively, for black ink printheads, the minimum wiping force $F_0$ (preload) is 150 grams force, the nominal deflection $D_{nom}$ is 1.0 mm and nominal wiping force $F_{nom}$ is 184 grams force, and the maximum deflection $D_{max}$ is 3.0 mm and maximum wiping force $F_{max}$ is 252 grams force.

It is to be understood that, in lieu of the above-described arrangement of print cartridge colors, other arrangements of the ink colors could be used and that other numbers of print cartridges (thus necessitating another number of wipers) could also be used. In that case, whichever wiper corresponds to the black ink cartridge (or any other cartridge that requires strong wiping) has leaf springs with a higher spring constant and/or higher preload so that the black ink printhead wiper has a higher printhead contact force than the other wipers. However, while desirable, it is not necessary according to the invention that the black ink wiper be constructed to have a stronger wiping force.

Figure 12:
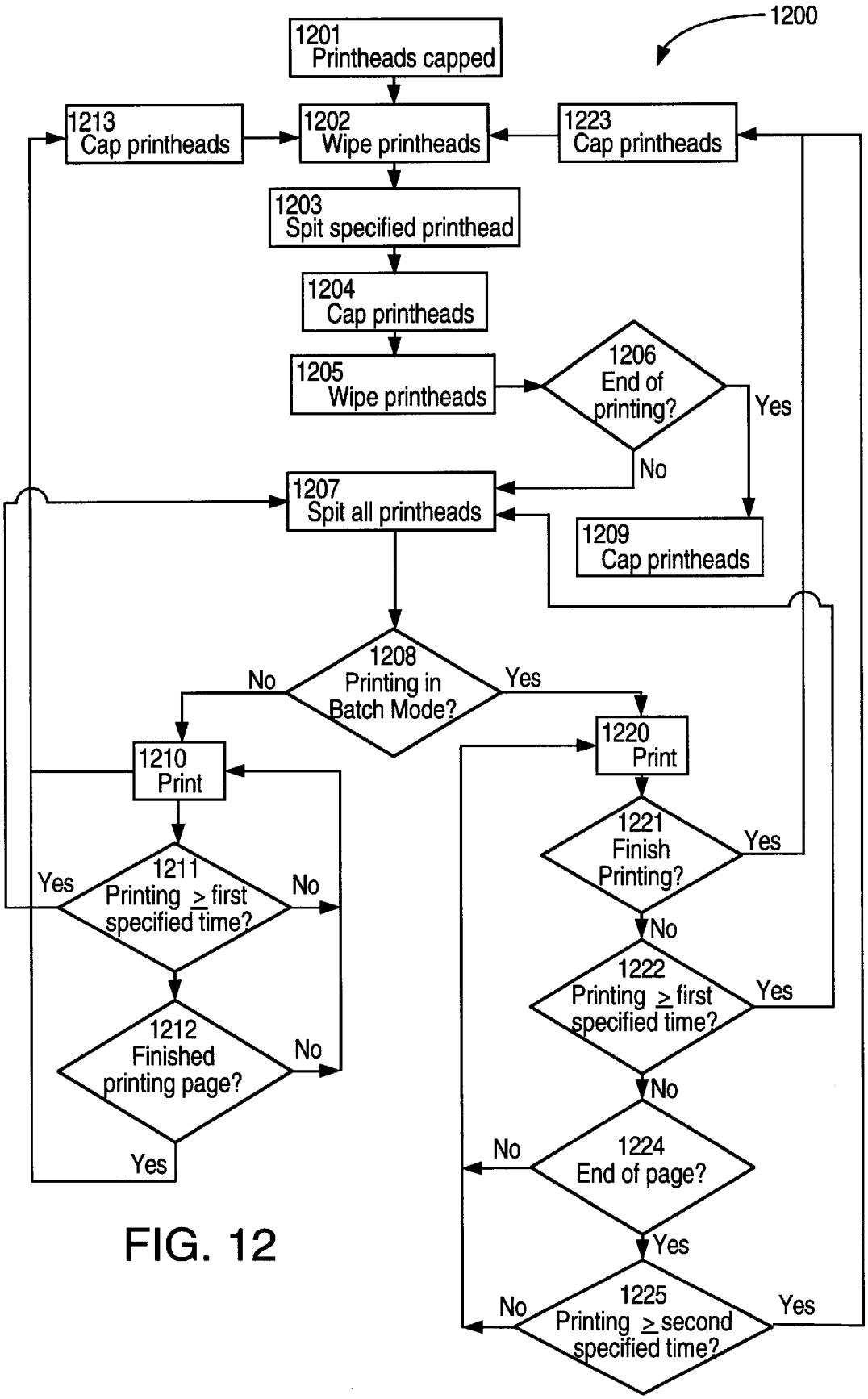
FIG. 12 is a flow chart of a method according to the invention for wiping printheads of a plurality of print cartridges.

In addition to increasing the wiping force of wiper 810 on the black printhead, the black ink print cartridge can also be spitted to aid in wiping. FIG. 12 is a flow chart of a method 1200 according to the invention for wiping printheads of a plurality of print cartridges. FIGS. 13A through 13D are simplified cross-sectional views showing various positions of the print cartridges with respect to the wipers, cappers and spittoon at various times during the method illustrated in FIG. 12.

Figure 13A:
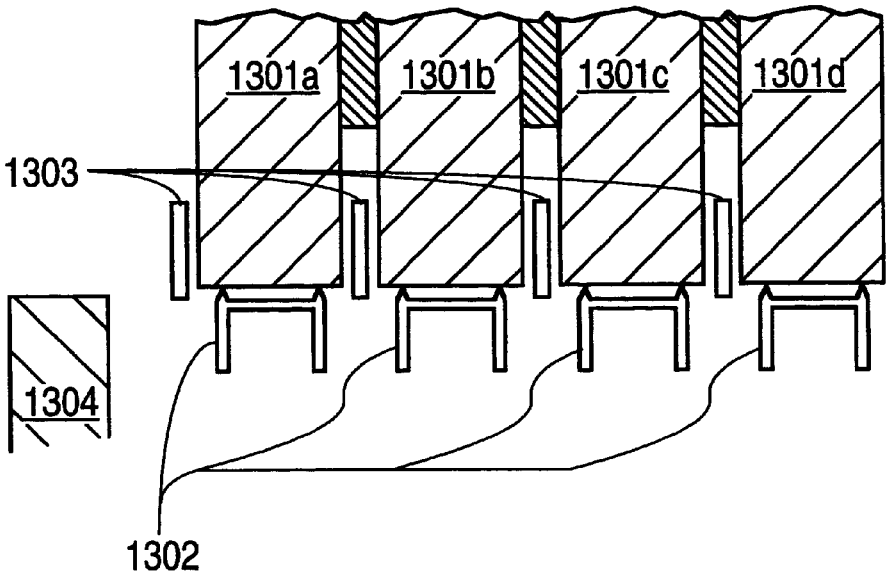
FIGS. 13A through 13D are simplified cross-sectional views showing various positions of the print cartridges with respect to the wipers, cappers and spittoon at various times during the method illustrated in FIG. 12.

In step 1201, the printhead of each print cartridge 1301*a*, 1301*b*, 1301*c*, 1301*d* (FIGS. 13A through 13D) is capped, i.e., the printhead is enclosed by one of caps 1302, as shown in FIG. 13A. For purposes of the following description, print cartridge 1301*d* dispenses a black pigmented ink and print cartridges 1301*a*, 1301*b*, 1301*c* dispense colored dye inks. However, it is to be understood that the below-described method according to the invention is broad enough to encompass other arrangements of pigmented and dye inks.

Figure 13B:
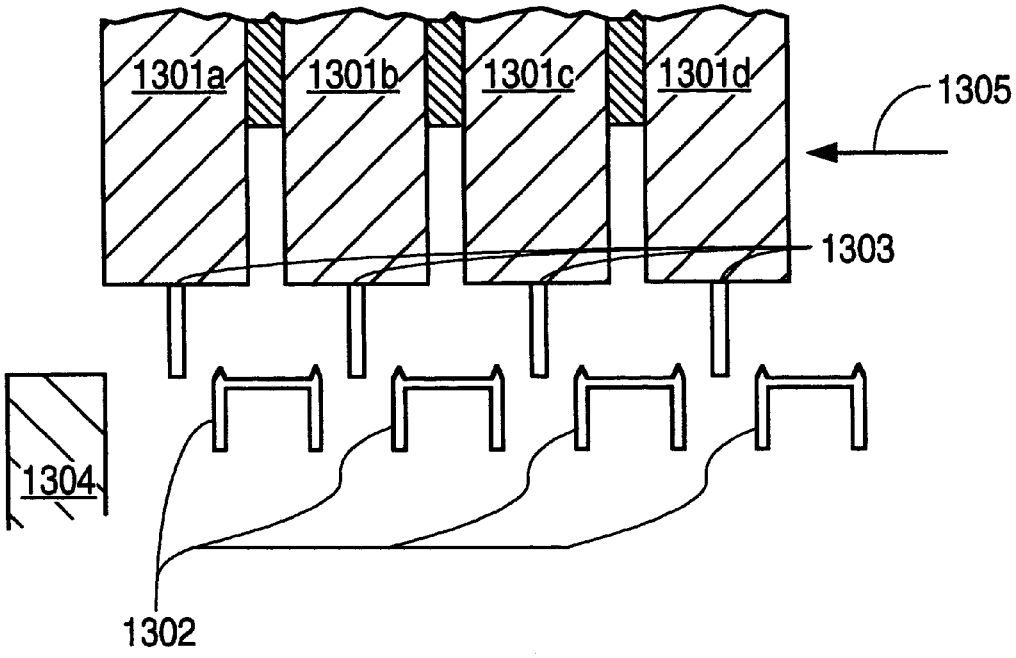

In step 1202, the printheads are wiped by wipers 1303, as shown in FIG. 13B. The print carriage (not shown) in which print cartridges 1301*a*, 1301*b*, 1301*c*, 1301*d* are positioned moves in the direction of the arrow 1305 causing the print carriage to move upward so that print cartridges 1301*a*, 1301*b*, 1301*c*, 1301*d* move above caps 1302 to contact the edge of wipers 1303, as described in more detail above.

Figures 13C, 13D:
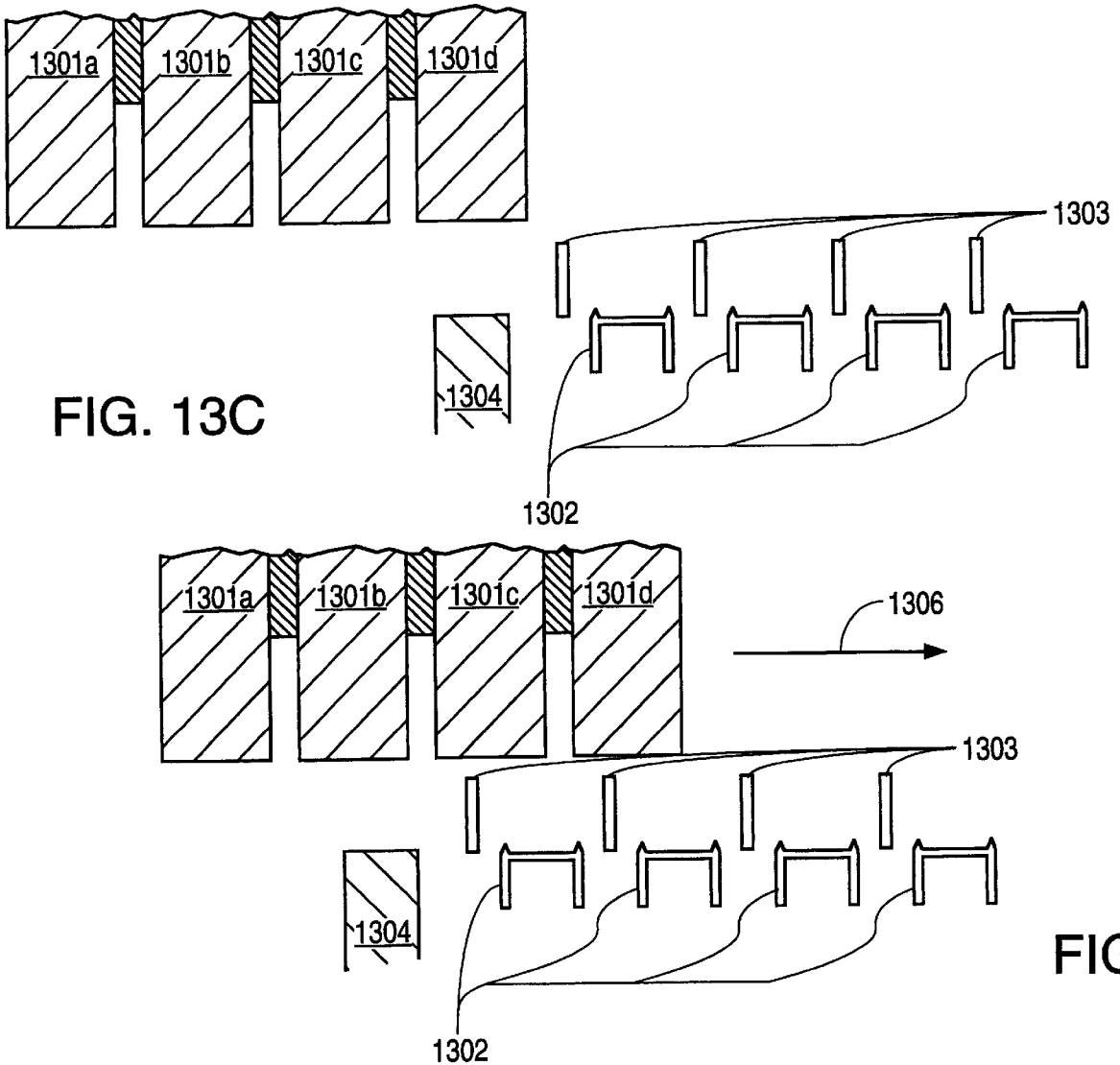

The print carriage continues to move in the direction of arrow 1305 until black ink print cartridge 1301*d* is above spittoon 1304, as shown in FIG. 13C. During this movement, after print cartridge 1301*d* has been wiped, the print carriage moves upward again, moving print cartridges 1301*a*, 1301*b*, 1301*c*, 1301*d* above the level of wipers 1303, as described in more detail above. When print cartridge 1301*d* is above spittoon 1304, the print carriage stops.

In step 1203, black ink print cartridge 1301*d* is spitted, i.e., ink drops are ejected from the nozzles of print cartridge 1301*d*. According to one embodiment of the invention, a plurality of ink drops are ejected from each printhead nozzle at each of a number of frequencies. Use of a range of firing frequencies promotes wetting of ink on the printhead surface to be wiped. In one embodiment, a multiplicity of drops of ink are fired from each nozzle at each 500 Hz increment in a range of frequencies (drops per second) between 3.5 kHz and 5 kHz inclusive. In one embodiment, from 5 to 20 drops are fired from each nozzle at each frequency, and, in a particular embodiment, 15 drops are fired from each nozzle at each frequency.

After black ink print cartridge 1301*d* is spitted, the print carriage begins to move in the direction of arrow 1306 (FIG. 13D) back to the capped position (FIG. 13A). When moving in this direction, the print carriage does not move downward, so that print cartridges 1301*a*, 1301*b*, 1301*c*, 1301*d* remain above wipers 1303 and are not wiped. In step 1204, the printheads are again capped by caps 1302.

In step 1205, the print carriage moves again in the direction of arrow 1305 (FIG. 13B) and the printheads are wiped by wipers 1303. The ink that wets the printhead of black ink print cartridge 1301*d* is wiped by one of wipers 1303 across the printhead, aiding in removal of contaminants from the printhead. The print carriage continues on to the spitting position shown in FIG. 13C.

As shown by step 1206, at this point, a determination is made as to whether the end of printing has occurred. If printing has ended, then the print carriage returns to the position shown in FIG. 13A and the printheads are capped, as shown in step 1209 of FIG. 12.

If printing has not ended, each of print cartridges 1301*a*, 1301*b*, 1301*c*, 1301*d* is spit, as shown by step 1207. Unlike the spitting of step 1203, in the spitting of step 1207, print cartridges 1301*a*, 1301*b*, 1301*c*, 1301*d* are spit at a single frequency which is, in one embodiment, 2 kHz. After spitting at step 1207, printing begins.

In step 1208, a determination is made as to whether the printer is printing in batch mode or single page mode. Herein, "batch mode" is defined as a mode in which the printer is instructed to print more than one page at a time, a page being defined as part of the printer control mechanism and typically consisting of a specified number of print lines.

If the printer is printing in batch mode, then, as shown in step 1220, the printer begins printing. In step 1221, a determination is made as to whether printing has been finished, i.e., whether all pages in the batch have been printed. If so, then the print carriage is moved to the capped position (FIG. 13A), as shown in step 1223. If not, then a determination is made as to whether the printer has been printing for greater than a first specified time, as shown by step 1222.

Step 1222 determines whether a maintenance spit is necessary, a maintenance spit being necessary if more than the first specified time has elapsed since the, last spit and wipe (steps 1202 through 1205) or since the last maintenance spit (step 1207). During a maintenance spit, a multiplicity of ink drops are spit from each of the print cartridges at a single frequency which is, in one embodiment, 2 kHz. The first specified time can be of any magnitude and is, in one embodiment, 12 seconds.

If a maintenance spit is necessary, then each of the print cartridges are spit, as indicated in step 1207. If a maintenance spit is not necessary, then, in step 1224, a determination is made as to whether the end of a page has been reached. If the end of a page has not been reached, then printing continues (step 1220).

If the end of a page has been reached, then a determination is made as to whether the printer has been printing for greater than a second specified time. The second specified time is measured from the last spit and wipe (steps 1202 through 1205) and is, in one embodiment, 42 seconds. If printing has not been occurring for longer than the second specified time, then printing continues (step 1220). If printing has been occurring for longer than the second specified time, then the print carriage is moved to the capped position (FIG. 13C), as shown in step 1223, and a spit and wipe is performed, as shown in steps 1202 through 1205.

If the printer is not printing in batch mode (step 1208), then, as shown in step 1210, printing begins. However, rather than printing multiple pages in a specified batch, only one page is printed. In step 1211, a determination is made as to whether the printer has been printing for greater than a first specified time. As in step 1222 above, step 1211 determines whether a maintenance spit is necessary. If a maintenance spit is necessary, then each of the print cartridges are spit, as indicated in step 1207. If a maintenance spit is not necessary, then, in step 1212, a determination is made as to whether the end of a page has been reached. If the end of a page has not been reached, then printing continues (step 1220). If the end of a page has been reached, then the print cartridges are returned to the capped position 1213 (FIG. 13A), as shown in step 1213.

Once the print carriage returns to the capped position in either step 1213 or step 1223, the previously described sequence of wiping, spitting, capping, wiping and spitting is repeated. Printing, interrupted by periodic spitting and wiping, continues until the printer is instructed to stop.

Generally, according to the invention, printheads of different print cartridges can be wiped differently, e.g., wiped with different wiping force, using any of the techniques described above. Further, one or more print cartridges can be spitted, as described above, before wiping if desired. In particular, print cartridges that dispense a pigmented ink, such as black pigmented ink, benefit from use of the above-described techniques for differential wiping of printheads and spitting of print cartridges before wiping.

As shown in FIGS. 9A and 9B, each connecting section 809*b* includes a centrally formed elongated hole. This hole is formed so that each connecting section 809*b* can twist more freely than would otherwise be the case. This twisting allows wiper 703*a* to twist during wiping, without changing wiper blade angle of attack 1002, so that wiper blade 810 makes good contact with printhead 1001*a* despite misalignment of wiper 703*a* with printhead 1001*a*.

Wiper mount section 809*a* includes a central section 909*a*, two extending portions 909*b* and a pair of flanges 909*c* extending downwardly (i.e., away from the printhead) from central section 909*a*. An elongated hole is formed through central section 909*a* and a circular alignment hole is formed through each of extending portions 909*b*. These holes in wiper mount section 809*a* allow wiper 703*a* to be insert molded into wiper mount section 809*a*, so that portions of wiper 703*a* extend through and interlock with the holes, thus holding wiper 703*a* in place. Flanges 909*c* add stiffness to wiper mount section 809*a* in the direction of wiping so that wiper blade 810 of wiper 703*a* is not easily deflected away from printhead 1001*a* (FIG. 10) during wiping, resulting in good contact (and, thus, good wiping) between wiper blade 810 and printhead 1001*a* during wiping. Flanges 909*c*, with connecting bars 813*a* and 703*d*, also define the maximum possible deflection of wiper blades 810, as described in more detail above.

Each of wipers 703*a* includes wiper blade 810 and two wiper blocks 812. Wiper blocks 812 rest on printhead 1001*a* while wiping is not occurring. The surface of wiper blade 810 that contacts printhead 1001*a* is nominally approximately 1 mm above, i.e., in a direction toward printhead 1001*a*, wiper blocks 812, resulting in approximately 1 mm of interference between wiper blade 810 and print cartridge 1001. Generally, wiper blocks 812 and wiper blade 810 can be formed so as to achieve any desired interference between wiper blade 810 and print cartridge 1001.

According to the invention, wipers 703*a* are made of an injection moldable material. For example, wipers 703*a* can be made of an injection moldable polymer such as an olefin polymer or a polyolefin alloy. In one embodiment, wipers 703*a* are made of a blend of polypropylene and polyethylene. If an injection moldable polymer is used, in a preferred embodiment, wipers 703*a* are made of a blend of polypropylene and polyethylene that is available from Ferro Co. of Evansville, Ind. as part no. NPP00NP01NA.

Alternatively, wipers 703*a* can be made of an engineering thermoplastic elastomer (ETE). In one embodiment, wipers 703*a* are made of du Pont's Hytrel 4556.

Use of the above materials yields a wiper that wears well when used with the structure according to the invention for wiping printheads of an inkjet printer. In particular, wiper blades made of the above materials do not wear as much as wiper blades made of rubber. Additionally, injection molding wipers 703*a* onto cross member 809 is a simple and inexpensive method for producing wipers 703*a*.

A plurality of leaf spring cushions 811 are insert molded into corresponding holes formed in wiper mount 802 at each juncture between one of leaf springs 807 and one of cross members 809. Each of leaf spring cushions 811 contact a corresponding one of retainers 808 on wiper frame 801. Leaf springs 807 are preloaded such that leaf spring cushions 811 are held against retainers 808 while wiper blades 810 are not in contact with a printhead, i.e., not wiping. Illustratively, the leaf springs 807 corresponding to wipers 703*a* that do not wipe a printhead used to print black ink are preloaded with a force of 80 grams force. The leaf spring 807 corresponding to wiper 703*a* that wipes a printhead used to print black ink is preloaded with a force of 150 grams force. The leaf spring 807 associated with the black ink printhead is preloaded by a greater amount for reasons explained more fully above.

Leaf spring cushions 811 reduce the noise that would otherwise result from contact between the metal wiper mount 802 and plastic retainers 808. In one embodiment, leaf spring cushions 811 are made of the same material as wipers 703*a*, e.g., a polyolefin alloy. Generally, leaf spring cushions 811 are made of any material that achieves the above-described objectives.

As seen in FIG. 8, wiper mount 802 includes connecting strips 814 formed between adjacent leaf springs 807 along each side of wiper mount 802. Generally, connecting strips 814 between leaf springs 807 are substantially parallel to the plane of the printhead surfaces (see FIG. 1C in combination with FIG. 8). However, each connecting strip 814*a* between a leaf spring 807*a* associated with the black ink printhead and the immediately adjacent leaf spring 807 is formed substantially perpendicular to the plane of the printhead surfaces. This occurs because the leaf springs 807*a* are made wider, as described in more detail below, than the remainder of the leaf springs 807. Consequently, connecting strip 814 between each leaf spring 807*a* and the corresponding adjacent leaf spring 807 must be formed as described so that the overall width of wiper mount 802 is not made unnecessarily large.

Returning to FIG. 7B, the assembly of sled 503 is described. Filters 704 are placed within each of the cavities formed below a corresponding cap mount 701*a*.

Caps 702*a* of cap structure 702 are stretched slightly and fitted over corresponding cap mounts 701*a* formed on a first surface 701*b* of sled body 701. Cap connecting bar 702*b* fits into a mating recess 701*g* formed in sled body 701. Cap structure 702 is held in place by the friction fit between each cap 702*a* and cap mount 701*a*.

Wiping structure 703 is mounted on first surface 701*b* of sled body 701 so that wiping structure 703 can be easily detached from sled body 701, as described in detail below.

Sled body 701 includes two extensions (not visible in FIG. 7B) that extend from a second surface of sled body 701 opposite first surface 701*b* on which wiper structure 703 is mounted. The extensions are formed proximal to a first end of sled body 701. Sled body 701 also includes two holes 701*d* formed proximal to a second end of sled body 701 that is opposite the first end of sled body 701.

Two snap arms 703*b* extend from a surface of wiper frame 801 and are proximal to a first end of wiper frame 801. Wiper structure 703 is positioned on sled body 701 so that snap arms 703*b* extend past the first end of sled body 701 to snap fit around the corresponding extensions extending from the second surface of sled body 701, thereby retaining wiper frame 801 to sled body 701.

Retention legs 703*c* extend from the surface of wiper frame 801 and are proximal to a second end of wiper frame 801 opposite the first end of wiper frame 801. Retention legs 703*c* extend through corresponding holes 701*d* in sled body 701. A foot is formed at the end of each of retention legs 703*c*, the foot contacting the second surface of sled body 701 to prevent retention legs 703*c* from being pulled out of holes 701*d*.

Wiper structure 703 is assembled to sled body as follows. Retention legs 703*c* of wiper frame 801 are fit through holes 701*d* of sled body 701. Wiper frame 801 is pivoted and moved so that the foot of each retention leg 703*c* extends under sled body 701 to contact the second surface of sled body 701 and so that each retention leg 703*c* contacts a surface of the corresponding hole 701*d*. Wiper frame 801 is then pivoted toward sled body 701 so that snap arms 703*b* extend past the first end of sled body 701. Wiper frame 801 is pivoted until snap arms 703*b* snap into place around the extensions of sled body 701. Mounting pins 804 (not visible in FIG. 7B, see FIG. 8) on the bottom of wiper structure 703 fit through corresponding holes 701*e* in sled body 701.

Wiper frame 801 is held in place, in a direction perpendicular to the first and second surfaces of sled body 701, by contact between snap arms 703*b* and the corresponding extensions, and by contact between the feet of retention legs 703*c* and the second surface of sled body 701. Wiper frame 801 is held in place, in a direction parallel to the first and second surfaces of sled body 701, by contact between connecting bar 703*d* of wiper structure 703 and protrusion 701*f* formed on sled body 701 adjacent recesses 701*c*, and by contact between retention legs 703*c* of wiper structure 703 and a surface within holes 701*d* of sled body 701.

Since wiping structure 703 can be easily assembled to and removed from sled body 701, as described above, wiping structure 703 according to the invention can be easily removed and replaced by a user without need to use tools. Thus, wiping structure 703 can be replaced (when, for instance, wiper blades 810 wear out) without need to replace any other parts of service station 500.

Returning to FIG. 5, after assembly of sled 503, and mounting of sled 503 on springs 502, cam holder 504 is mounted over sled 503. Cam holder 504 is tilted and legs 504*e*, formed on either side of cam holder 504, are fitted into corresponding holes (not shown) formed in a side wall 501*a* of chassis 501. The opposite end of cam holder 504 is then lowered into contact with sled 503. Cam holder 504 is thereby held in place, since cam holder 504 cannot rotate about a contact point between legs 504*e* and corresponding holes, due to the contact between the screws and corresponding walls 501*b*.

While the present invention has been described with reference to the foregoing operational principles and embodiments, it will be apparent to those skilled in the art that other changes in form and detail may be made therein without departing from the spirit and scope of the invention as defined in the appended claims.

We claim:

1. Wiping structure for use with an inkjet printer including a movable print cartridge having a printhead from which ink is dispensed, comprising:

a wiper including a wiper blade that is made of a stiff material, such that the wiper does not bend, or bends, at most, a negligible amount, when wiping; and spring means attached to the wiper for compliantly supporting the wiper, wherein:

the spring means positions the wiper blade when the wiper is not wiping such that, viewed in a direction perpendicular to a direction of movement of the print cartridge during wiping, the wiper blade overlaps the print cartridge; and the spring means deflects during wiping to enable the wiper blade to contact the printhead, the spring means biasing the wiper blade against the printhead to effect wiping.

2. Wiping structure as in claim 1, wherein:

the wiper blade has a surface that, during wiping, defines a wiper blade angle of attack with respect to the printhead; and the wiper blade is sufficiently stiff so that the wiper blade angle of attack during wiping is different from the wiper blade angle of attack when the wiper is not wiping due only to deflection of the spring means and not to bending of the wiper blade.

3. Wiping structure as in claim 1, wherein the wiper blade has a surface that, during wiping, defines a wiper blade angle of attack with respect to the printhead that is greater than or equal to 75° during wiping.

4. Wiping structure as in claim 1, wherein:

the spring means is preloaded to maintain a minimum wiping force of the wiper blade against the printhead; and the spring means has a spring constant such that, for the range of possible deflections of the wiper blade, a maximum wiping force is less than or equal to 40% greater than the minimum wiping force.

5. Wiping structure as in claim 1, wherein the printer includes a plurality of movable print cartridges each having a printhead from which ink is dispensed, the wiping structure further comprising:

a plurality of wipers, each wiper including a wiper blade that is made of a stiff material, such that the wiper does not bend, or bends, at most, a negligible amount, when wiping; and a plurality of spring means, each spring means being attached to a corresponding one of the wipers for compliantly supporting the wiper, wherein:

each spring means positions the wiper blade of the corresponding wiper when the wiper is not wiping such that, viewed in a direction perpendicular to a direction of movement of a corresponding print cartridge during wiping, the wiper blade overlaps the print cartridge; and the spring means deflects during wiping to enable the wiper blade to contact the printhead of the corresponding print cartridge, the spring means biasing the wiper blade against the printhead to effect wiping.

6. Wiping structure as in claim 1, wherein the wiper blade is made of an injection moldable material.

7. Wiping structure as in claim 1, wherein the wiper blade is made of an injection moldable polymer.

8. Wiping structure as in claim 1, wherein the wiper blade is made of a polyolefin alloy.

9. Wiping structure as in claim 1, wherein the wiper blade is made of a blend of polypropylene and polyethylene.

10. Wiping structure as in claim 1, wherein the wiper blade is made of an engineering thermoplastic elastomer.

11. Wiping structure for use with an inkjet printer including a movable print cartridge having a printhead from which ink is dispensed, comprising:

a wiper including a wiper blade that is made of a stiff material, such that the wiper does not bend, or bends, at most, a negligible amount, when wiping; and a pair of leaf springs for compliantly supporting the wiper, wherein:

the leaf springs facilitate positioning the wiper blade when the wiper is not wiping such that during wiping, the wiper blade overlaps the print cartridge; and the leaf springs deflect during wiping to enable the wiper blade to contact the printhead, the leaf springs biasing the wiper blade against the printhead to effect wiping.

12. Wiping structure as in claim 11, further comprising:

a cross member compliantly connecting the springs and the wiper blade mounted on the cross member, the cross member formed such that, during wiping, the cross member can deform so as to maintain the wiper blade in contact with the printhead along substantially an entire length of the wiper blade.

13. Wiping structure as in claim 12, wherein the cross member further comprises:

a wiper mount section on which the wiper blade is mounted; and first and second connecting sections, each connecting section located between the wiper mount section and corresponding ones of the springs, wherein each connection section is formed so as to achieve desired spring characteristics of the cross member that maintain the wiper blade in contact with the printllead along substantially the entire length of the wiper blade during wiping.

14. Wiping structure as in claim 11, further comprising:

a cross member connecting the springs, the wiper blade mounted on the cross member, the cross member formed such that, during wiping, the cross member substantially inhibits wiper blade rotation about an axis parallel to a printhead surface being wiped and perpendicular to movement of the print cartridge during wiping.

15. Wiping structure as in claim 14, wherein the cross member further comprises a wiper mount section including a planar portion and first and second flanges, the wiper blade mounted on the planar portion of the wiper mount section, and the first and second flanges extending from opposite sides of the planar portion, the first and second flanges each formed at an angle with respect to the planar portion.

16. Wiping structure for use with an inkjet printer including a movable print cartridge having a printhead from which ink is dispensed, comprising:

a wiper including a wiper blade that is made of a stiff material, such that the wiper does not bend, or bends, at most, a negligible amount, when wiping, the wiper blade having a surface that, during wiping, defines a wiper blade angle of attack with respect to the printhead; and spring means attached to the wiper for compliantly supporting the wiper, wherein:

the spring means deflects during wiping and biases the wiper blade against the printhead; and the undeflected position of the spring means when the wiper is not wiping, the orientation of the wiper blade surface with respect to the spring means when the wiper is not wiping, and the orientation of the spring means with respect to the plane of the printhead when the wiper is not wiping are controlled so that the wiper blade angle of attack is greater than or equal to 75° during wiping.

17. Wiping structure as in claim 16, wherein the wiper blade is made of an injection moldable material.

18. Wiping structure as in claim 16, wherein the wiper blade is made of an injection moldable polymer. elastomer.

19. Wiping structure as in claim 16, wherein the wiper blade is made of a polyolefin alloy.

20. Wiping structure as in claim 16, wherein the wiper blade is made of a blend of polypropylene and polyethylene.

21. Wiping structure as in claim 16, wherein the wiper blade is made of an engineering thermoplastic elastomer.

22. A printhead wiping system, comprising:

a moveable carriage mounted for rectilinear movement along a fixed carriage path of travel;

at least one printhead mounted removably in said carriage and having a plurality of inkjet nozzles disposed on a lower surface thereof for discharging ink droplets downwardly toward a medium surface disposed beneath said carriage;

a cammed service station sled disposed spaced beneath said carriage at one end of said fixed carriage path of travel;

a wiper blade mounted to said sled for engaging the lower surface of said printhead at a wiper blade angle of attack of substantially greater than seventy five degrees with a minimum wiping force $F_0$ when said wiper blade is in a resting position with no deflection D;

said sled and said carriage moving relative to one another to cause said wiper blade to rotate to a wiping position with a decreased wiper blade angle of attack of about seventy five degrees to apply a nominal wiping force $F_{nom}$ to the nozzles of said printhead;

a pair of preloaded springs coupled to said wiper blade for permitting it to be pushed downwardly a sufficient distance to pass over said printhead when in said wiping position;

said sufficient distance permitting said wiper blade to remain in a substantially non-bent configuration while applying said nominal wiping force $F_{nom}$ to said printhead for cleaning purposes.

23. A wiper structure for cleaning an inkjet printhead having a lower surface with a plurality of inkjet nozzles disposed therein, comprising:

a rotatable wiper mount, said wiper mount including:

a wiper blade having sufficient predefined material properties to permit engagement with the lower surface of the printhead with a nominal wiping force $F_{nom}$ at a wiper blade angle of attack of about seventy five degrees without substantial bending; and a pair of springs molded to said wiper blade to enable the material properties of said wiper blade to be decoupled from the wiping force and wiper blade angle of attack associated with the wiper blade so that said wiper blade remains in a substantially non-bent configuration when wiping the lower surface of said printhead with said nominal wiping force $F_{nom}$.

* * * * *